US005615794A

United States Patent [19]

Murray, Jr.

[11] Patent Number: 5,615,794

[45] Date of Patent: Apr. 1, 1997

[54] ASSEMBLY FOR SEALING A LID TO A MATING CONTAINER BODY

[75] Inventor: Holt Murray, Jr., 6 Prospect St., Hopewell, N.J. 08525

[73] Assignee: Holt Murray, Jr., Hopewell, N.J.

[21] Appl. No.: 363,292

[22] Filed: Dec. 23, 1994

Related U.S. Application Data

[62] Division of Ser. No. 16,990, Feb. 10, 1993, Pat. No. 5,391, 887.

[51] Int. Cl.[6] ..... B65D 53/00

[52] U.S. Cl. ..... 220/304; 277/235 A; 220/378

[58] Field of Search ..... 277/226, 236, 277/DIG. 6, 235 A, 227, 164, 234; 220/304, 378

[56] References Cited

U.S. PATENT DOCUMENTS

| | | | |
|---|---|---|---|
| 2,376,593 | 5/1945 | Hellen | 220/378 |
| 2,758,367 | 8/1956 | Dougherty . | |
| 3,007,600 | 11/1961 | Horner | 277/236 |
| 3,055,538 | 9/1962 | Schoessow | 220/378 X |
| 3,144,035 | 8/1964 | Hablanian et al. | 220/238 X |
| 3,181,722 | 5/1965 | Huston | 220/378 X |
| 3,327,892 | 6/1967 | Lloyd et al. . | |
| 3,330,720 | 7/1967 | Stevens et al. | 215/347 X |
| 3,406,863 | 10/1968 | Wenzel et al. | 220/378 X |
| 3,542,382 | 11/1970 | Hagmann | 277/211 |
| 3,615,281 | 10/1971 | Ramsden | 29/199 |
| 3,734,387 | 5/1973 | Sannipoli . | |
| 3,754,141 | 8/1973 | Leebl et al. . | |
| 3,770,964 | 11/1973 | Backus . | |
| 3,817,540 | 6/1974 | Nicholson | 277/236 |
| 4,043,894 | 8/1977 | Gibbs | 204/297 |
| 4,053,085 | 10/1977 | Brown et al. | 277/22 X |
| 4,078,811 | 3/1978 | Bock et al. . | |
| 4,187,410 | 2/1980 | Eroshkin et al. . | |
| 4,274,007 | 6/1981 | Baatz et al. . | |
| 4,320,847 | 3/1982 | Gesser et al. . | |
| 4,326,642 | 4/1982 | Wolf | 220/200 |
| 4,421,325 | 12/1983 | Napolitano | 277/236 X |
| 4,445,042 | 4/1984 | Baatz . | |
| 4,508,969 | 4/1985 | Janberg et al. . | |
| 4,527,065 | 7/1985 | Popp et al. . | |

(List continued on next page.)

FOREIGN PATENT DOCUMENTS 2235260 2/1991 United Kingdom .

OTHER PUBLICATIONS

Doering, T.W. and Stahl, D.; "High Level Nuclear Waste Retrievability"; *The Proceedings Of The Third International Conference On High Level Radioactive Waste Management,* Apr. 12–16, 1992, pp. 362–365.

Peters, D., Kundig, K., and Medley, D.; "Multi–Barrier, Copper–Base Containers For HLW Disposal"; *The Proceedings Of The Third International Conference On High Level Radioactive Waste Management,* Apr. 12–16, 1992, pp. 366–367.

Janberg, K., Spilker, H., and Huggenberg, R.; "The German Cask–Concept For Intermediate And Final Storage Of Spent Fuel"; *The Proceedings Of The Third International Conference On High Level Radioactive Waste Management,* Apr. 12–16, 1992, pp. 385–394.

*Primary Examiner*—Allan N. Shoap
*Assistant Examiner*—Robin A. Hylton
*Attorney, Agent, or Firm*—Watov & Kipnes, P.C.

[57] ABSTRACT

A container for storing hazardous waste material, particularly radioactive waste material, consists of a cylindrical body and lid of precipitation hardened C17510 beryllium-copper alloy, and a channel formed between the mated lid and body for receiving weld filler material of C17200 copper-beryllium alloy. The weld filler material has a precipitation hardening temperature lower than the aging kinetic temperature of the material of the body and lid, whereby the weld filler material is post weld heat treated for obtaining a weld having substantially the same physical, thermal, and electrical characteristics as the material of the body and lid. A mechanical seal assembly is located between an interior shoulder of the body and the bottom of the lid for providing a vacuum seal.

2 Claims, 17 Drawing Sheets

U.S. PATENT DOCUMENTS 4,527,959 7/1985 Popp et al. .
4,535,250 8/1985 Fields .
4,594,214 6/1986 Popp et al. .
4,596,688 6/1986 Popp .
4,597,582 7/1986 Muller ..... 277/53
4,635,896 1/1987 Baker ..... 277/236 X
4,673,814 6/1987 Schroeder et al. .
4,702,391 10/1987 Koester et al. .
4,738,388 4/1988 Blenek et al. .
4,758,402 7/1988 Schukei et al. ..... 220/378 X
4,818,878 4/1989 Popp et al. .
4,847,009 7/1989 Madle et al. .
4,872,563 10/1989 Warder et al. .
4,881,678 11/1989 Gaudin .
4,883,637 11/1989 McDaniels .
4,976,912 12/1990 Madle et al. .
5,015,863 5/1991 Takeshima et al. .
5,322,299 6/1994 Terai ..... 277/227 X

ASSEMBLY FOR SEALING A LID TO A MATING CONTAINER BODY

This is a divisional application of U.S. Ser. No. 08/016,990, now U.S. Pat. No. 5,391,887, filed on Feb. 10, 1993.

RELATED INVENTION

The invention of the present application is related to co-pending application Ser. No. 07/951,209, filed on Sep. 25, 1992, for METHOD AND APPARATUS FOR WELDING PRECIPITATION HARDENABLE MATERIALS. The teachings of this co-pending application are incorporated into this present application in their entirety by reference, provided any such teachings are not inconsistent with any teachings herein.

BACKGROUND OF THE INVENTION

1. Field of The Invention

The field of the present invention relates generally to hazardous waste management, and more particularly to the management of radioactive waste materials.

2. Discussion of Related Art

The management of hazardous waste material, including radioactive, biological, and chemical waste, is of critical concern to maintaining a safe environment. The management of such waste is multifaceted. An initial concern is to insure a high level of safety in handling these wastes at any given time. As such waste material is produced at a given site, the first concern is the containment of such hazardous waste products or material. As the secured waste material accumulates at a given site, the next concern is to transport the material away from the site in approved shipping containers, for delivery to a specialized facility for either storage and/or processing. Typically, high-level nuclear waste material produced at nuclear utility sites must be locally secured for a period of about 10 to 20 years. Thereafter, the radioactive waste material is planned to be transported to a specialized facility for longer term storage, and/or waste processing. In such intermediate term storage facilities nuclear waste may be stored in containers for 40 to 100 years, with the contents being accessible, which requires that the high-level nuclear waste must be retrievable and inspectable. After the passage of the intermediate storage time, the nuclear waste material may be processed or transported to other specialized sites for long term storage, for periods ranging from 300 to 1,000 years, for example. One such long term storage site is currently planned for the Tuff Repository in Nevada. As previously indicated, the management of hazardous waste material is not limited to radioactive waste, and similar concerns are associated with the management of biological and chemical waste. For chemical and biological wastes, the hazardous material may be processed, and rendered benign while in the container. However, radioactive waste management is particularly difficult in view of certain nuclear waste materials retaining high levels of radio activity for thousands of years.

Over the past 40 years there has been increasing concern and activity in providing appropriate containers and inspection apparatus for the storage of hazardous waste, particularly nuclear waste material. Recently, a number of articles have been published describing present activities in these areas. One article by T. W. Doering and D. Stahl, entitled "High Level Nuclear Waste Retrievability", appeared in *The Proceedings of The Third International Conference on High Level Radioactive Waste Managment*, Apr. 12–16, 1992, pages 362–365, and describes a design of waste packages for deep geologic disposal of spent nuclear fuel, and high-level waste glass. The inspectability of such waste packages is also discussed.

In another article by D. Peters, K. Kundig, and D. Medley, entitled "Multi-Barrier, Copper-Base Containers for HLW Disposal", from *The Proceedings of The Third International Conference on High Level Radioactive Waste Management*, Apr. 12–16, 1992, pages 366–376, the use of copper and aluminum bronze for such containers is discussed. Various types of containers using such materials are also shown and described. The use of copper for various portions of such containers is emphasized.

Another article by K. Janberg, H. Spilker, and R. Huggenberg, entitled "The German Cask-Concept for Intermediate and Final Storage of Spent Fuel", from *The Proceedings of The Third International Conference on High Level Radioactive Waste Management*, Apr. 12–16, 1992, pages 385–394, shows and describes various designs for canisters for use in storing radioactive material. The basic design includes a final disposal cask or canister stored within an outer shielding cask or canister. Each canister is provided with its own lid.

Over the past 40 years many U.S. patents have been obtained for various container designs for storing nuclear waste. A number of such patents are discussed immediately below.

Dougherty, U.S. Pat. No. 2,758,367, shows a down welding process for welding closure caps to cylindrical containers. The cylindrical containers are oriented on a lathe-like device, with the longitudinal access of the container being parallel to the horizontal plane. A welding head is positioned proximate a circumferential groove for receiving a welding bead, with the welding head being above the cylinder and groove for providing down welding. As the cylinder is rotated the welding head is operated for causing a weld bead to be formed within the circumferential groove.

Lloyd et al., U.S. Pat. No. 3,327,892, shows a stainless steel tubular container for storing nuclear material. The end of the container is sealed via a cup-shaped lid 2. The upper circumferential edge of the cup lid 2 is welded via a circumferential weld 7 to the top edge of the container 1. Copper brazing is used to seal the sides of the cup lid 2 to opposing sides of the container 1.

Sannipoli, U.S. Pat. No. 3,734,387, teaches a tank fabrication system, whereby individual sections of a large cylindrical tank are oriented with their longitudinal axes parallel to the horizontal plane, and placed upon movable trollies. Apparatus is shown for rotating two sections to be joined for permitting welding thereof via a welding head positioned above the intersection between the two sections.

Eroshkin et al., U.S. Pat. No. 4,187,410, teaches a method for joining two pieces of metal together through use of a multi-pass welding bead within a narrow groove formed between the pieces.

Gesser et al, U.S. Pat. No. 4,320,847, shows a container for storing spent fuel elements that is substantially cylindrical in its main lower portion and has an uppermost portion that has diverging walls. A cup-like lid is fitted within the uppermost portion of the outwardly flaring wall members for sealing the container. The cup-like cap is welded about its circumferential lip to the interior wall portion of the frusto conical widening at the upper portion of the container.

Janberg, U.S. Pat. No. 4,508,969, shows a cylindrical container for storing spent reactor fuel elements. The container is closed off by a dome shaped lid or top member. The material for the container is indicated as being carbon steel or high-grade steel where thinner walls can be used. The outer portion of the container is a shielding layer made of polyethylene or some other hydrocarbon for absorbing residual neutron radiation.

Popp et al. U.S. Pat. No. 4,527,065, shows a storage container for the long term storage of radioactive material. The container is made from material such as cast iron and cast steel. A relatively flat cap or cover 6 is shaped to provide a circumferential weld groove between the bottom portion of the cap and the top lip of the container for permitting the cap to be welded to the container.

Popp et al., U.S. Pat. No. 4,572,959, shows a container for the long term storage of radioactive waste. The container is cylindrical and includes in the topmost portion a circular recess for receiving a closure cap or plug 4. A circumferential welding groove is formed between a beveled upper portion of the cap and a beveled or sloping interior topmost rim portion of the container, for receiving a weld bead. The container includes an interior base portion of cast iron, an outer wall layer 3 made of high-alloy austenitic nodular cast iron, and an interior cover 5 is fitted below the top cap 4.

Popp, U.S. Pat. No. 4,596,688, shows a container for the long term storage of radioactive materials that is made of steel, cast steel or similar material. The container is multilayered and substantially cylindrical in shape. The open top end is sealed by a multilayered cap which is shaped to form a circumferential groove with the top lip of the container for receiving a weld bead. Protective layers of the container are made of graphite, ceramic material or an enamel material.

Warder et al., U.S. Pat. No. 4,872,563, shows a container for storing hazardous materials. The container is particularly designed for storing biological materials.

Gaudin, U.S. Pat. No. 4,881,678, shows a robotic welding system that is remotely controlled. The system employs a welding process for applying a weld bead in multiple passes into a groove between two parts to be joined.

Madle et al. U.S. Pat. No. 4,976,912, teaches an apparatus for welding and testing a weld on a cover for sealing a container storing radioactive material. The system provides for mounting the container vertically on a rotatable platform. The system further includes a bridge-like arrangement for retaining welding tools in a fixed position for welding the cap to the top of the container as the container is rotated. Inspection tools are also located on the bridge in a fixed container for permitting inspection of the weld as the container is rotated.

Leebl, et al., U.S. Pat. No. 3,754,141, shows a storage container for radioactive material. The container is cylindrical and is provided with a shallow cup-like cap or lid. The container actually includes multiple containers surrounding one another.

Backus, U.S. Pat. No. 3,770,964, shows a container for storing radioactive material. This container shows a pair of annular seals 32 disposed within circular grooves for sealing a bottom portion of a cap to an interior ledge-like lip portion of the container.

Bock et al., U.S. Pat. No. 4,078,811, shows a sealing device that includes an elastic circumferential seal 3 for sealing a lid to the top of a container.

Baatz et al., U.S. Pat. No. 4,274,007, shows the use of a plurality of a "O"-ring seals between a step-shaped lid member and the interior step-like ledge and side portions of the upper portion of a storage container. The "O"-rings are contained within annular grooves.

Baatz et al. U.S. Pat. No. 4,445,042, shows a cylindrical container for radioactive waste that shows the use of metal "O"-rings, metal, elastomeric "O"-rings, and metal-to-metal seals, for sealing a converging step-like lid to a diverging stepped interior upper portion of the container.

Fields, U.S. Pat. No. 4,535,250, shows a container for radioactive material including silicone rubber seals 20, 29 and 31 for sealing a lid to the top of the container.

Popp et al., U.S. Pat. No. 4,594,214, shows a container for storing radioactive materials that includes a plurality of concentric layers or containers within a container. The innermost container is sealed by a screwed in cap. An intermediate portion of the container is sealed via a cup-like cap welded to an upper lip of the outer container via a topmost circumferential welding groove between the cap and interior side edge of the outer container. An outermost cap is screwed onto the top of the container.

Schroeder et al., U.S. Pat. No. 4,673,814, shows a cylindrical container for storing radioactive material. The container includes an interior uppermost diverging wall portion for receiving a cap member having outwardly diverging sides. The cap is welded via a weld groove to an interior portion of the uppermost wall of the container.

Koester et al, U.S. Pat. No. 4,702,391, disclose a corrosion resistant container for radioactive material. The container is lined with titanium-palladium alloy applied by explosion plating. Electron beam welding is used to close seams in the container. The bottom and cover lid of the container are apparently made of steel plates covered with a corrosion protected layer of titanium-palladium alloy applied by explosion plating. A circumferential weld is used about the bottom and top portions of the container. A cover plate 6 is used to cap off the container.

Bienek et al, U.S. Pat. No. 4,738,388, shows a container for storing radioactive material. The container is cylindrically shaped. A dual element cap mechanism is used for closing off the container. The cap includes metal-to-metal sealing, and is provided with a main first member that screws into the interior upper portion of the container, and forms a topmost circumferential groove 17 with the inside edge of the top portion thereof for receiving a weld bead.

Popp et al., U.S. Pat. No. 4,818,878, shows a double container for storing radioactive material. Several different embodiments are disclosed for sealing the top of the container through use of different capping mechanisms. Metal sealing rings are disclosed, as are the use of circumferential welding grooves for receiving a weld for sealing capping members to the container.

Madle et al., U.S. Pat. No. 4,847,009, shows a container for storing radioactive material that includes an inner container provided with a dome lid 8. The inner container is contained within an intermediate container that also is sealed at its top end with a dome lid 12.

McDaniels, Jr., U.S. Pat. No. 4,883,637, shows a closure arrangement for a container containing radioactive waste. "O"-ring seals 31 are used for sealing off one portion of a cap 26 to an interior flange or lip in an upper portion of a container.

Takeshima et al., U.S. Pat. No. 5,015,863, shows the use of shielding material for shielding nuclear waste containers. Composite particles are used to form the radiation shield from a group of materials including, but not limited to, oxides of beryllium, beryllium alloys, copper, copper alloys, and so forth.

SUMMARY OF THE INVENTION

An object of the invention is to provide an improved container for both the short and long term storage of hazardous waste material.

Another object of the invention is to provide an improved lid for a container for hazardous waste, for facilitating the short term and intermediate term storage of such waste.

Another object of the invention is to provide a lid for a container for hazardous waste, for facilitating the long term storage of such waste, whereby the improved lid further facilitates periodic inspection of the closure mechanism.

Another object of the invention is to provide a container which can be unsealed, the contents inspected or modified, and the container resealed.

Yet another object of the invention is to provide an improved container for storing hazardous waste that is compatible with common remote manipulator apparatus.

Another object of the invention is to provide an improved container for storing and sealing hazardous waste using mechanical means.

Another object of the invention is to provide a configuration of container, lid and weld all of which take advantage of mechanical stability, high strength and isotrophy inherent in precipitation hardenable material.

Yet another object of the invention is to provide an improved container for storing hazardous waste that includes high mechanical integrity, and facilitates automatic welding of sealing lids or caps thereto.

With these and other objects of the invention in mind, the present invention provides in one embodiment for intermediate and long term storage of hazardous waste, an elongated cylinder consisting of an age hardenable alloy, for example copper-beryllium alloy material. The container is provided with a dome shaped lid including three tapered horizontal holes at the ends of slots evenly spaced about the circumference, for receiving handling apparatus for both installing and removing the lid from the container, establishing the mechanical seal, and for lifting the container with the lid connected thereto. The lower portion of the dome lid is threaded for screwing into the top of the cylindrical container and forming a mechanical seal therewith. A groove is provided about the circumference of the dome lid where it meets with the top edge of the container for receiving a multi-turn helical weld bead. The weld filler material is also an age hardenable alloy, for example a copper-beryllium alloy material. After welding, the weld is heat-treated for causing the weld material to become precipitation hardened to have substantially the same mechanical characteristics as the material of the container.

In another embodiment of the invention, the cylindrical storage container is provided with a cup-like cap. The cup-like cap includes a smooth uppermost track surface similar to the lip of a cup for receiving a remote inspection tool that is able to rotate about the lip of the cup for inspecting the seals between the cap and the main cylinder body through use of ultrasonic or x-ray inspection. A groove is formed between the top of the container and the overlapping portion of the cup-like cap for accepting a multi-layer helical weld bead, similar to the dome-cap embodiment of the invention previously mentioned. The interior inside surface of the cup-like lid is indexed in order to permit the inspection tool to locate itself at all times relative to its position on the cap, thereby permitting rapid identification of any given area of the cap under inspection.

In either of the dome lid or cup-like lid or cap embodiments of the invention, "O"-ring, laminate metal, and/or temperature triggered metal sealing means are used between the bottom of the lids or cap and adjoining shoulder or inside wall surface of the respective lids.

BRIEF DESCRIPTION OF THE DRAWINGS

Various embodiments of the present invention are described below with reference to the drawings, in which like items are identified by the same reference designation, and in which.

DETAILED DESCRIPTION OF THE PREFERRED EMBODIMENTS OF THE INVENTION

Figure 1:
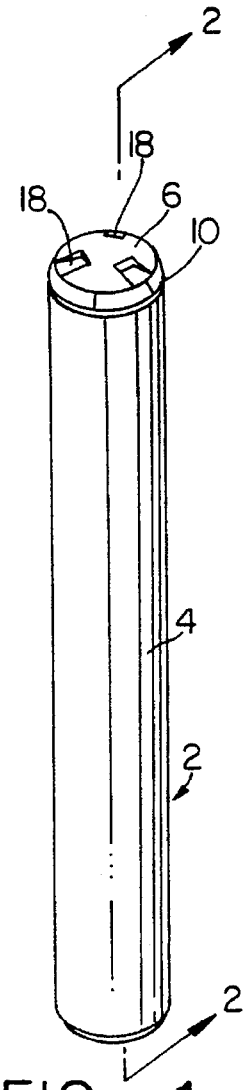
FIG. 1 shows a pictorial view from above the top of a hazardous waste container with a dome lid for one embodiment of the invention.
Figure 6:
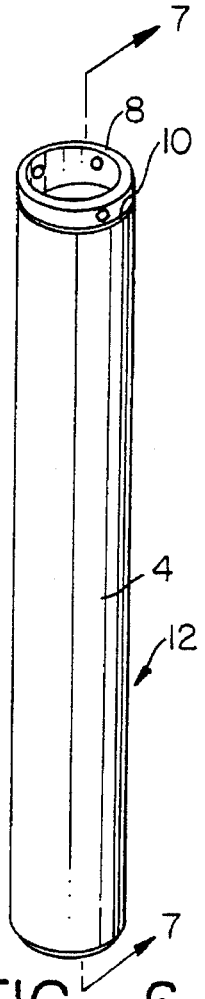
FIG. 6 is a pictorial drawing of a hazardous waste container including a cup-like lid or cap for another embodiment of the invention.

As shown in FIGS. 1 and 6, the present container 2 includes an elongated cylindrically shaped body 4, but is not meant to be so limited. In the embodiment of FIG. 1, a dome lid 6 provides a closure for the open top of body 4. In the example of storing high-level nuclear waste, the embodiment of FIG. 1 provides for the securing for tens of years at the utility site and intermediate term storage under conditions where the container 2 is accessible for monitoring, and the high-level nuclear waste are retrievable and inspectable and for containment for containment for hundreds of years at a repository complex. The embodiment of FIG. 1 represents either a stand alone container 2, or the container 2 of a container-shield set or the core of a containment system which is a concept where corrosion, mechanical integrity and shielding are discretely addressed. The design of the configuration of FIG. 1 is described in greater detail below.

In another embodiment of the invention shown in FIG. 6, a container 12 includes a body 4 that is closed off by a cup-like lid or cap 8. Note that, as shown, containers 2 and 12 each have substantially similar bodies 4. This embodiment provides special advantages for long term storage of nuclear waste, typically requiring complete containment for periods of hundreds of years. This alternative embodiment is described in greater detail below.

In one preferred embodiment of the invention, the bodies 4 fabricated from precipitation hardenable alloys, as are the lids 6 and 8, respectively, and the weld filler material providing the weld 10 for securing the dome lid or cap 6 and cup-lid 8 to their associated bodies 4, respectively. The present inventor determined that such alloys are desirable for use in containers for storing hazardous waste, in view of the superior mechanical stability, homogenous properties, cyclic fatigue capability, high fracture toughness, and significant impact strength. He recognized that the alloys are ideal for containing high-level radioactive waste material, for example. More specifically, he discovered that one of the preferred material for the body 4, lids 6 and 8, and weld 10, is copper-beryllium. However, the present invention is not meant to be limited to that family of alloys. Also, although the present description emphasizes the use of the various embodiments of the invention for providing containers for radioactive waste material, the containers in the various embodiments of the invention are also suitable for use for storing chemical, biological, and other such hazardous waste material.

Figure 2:
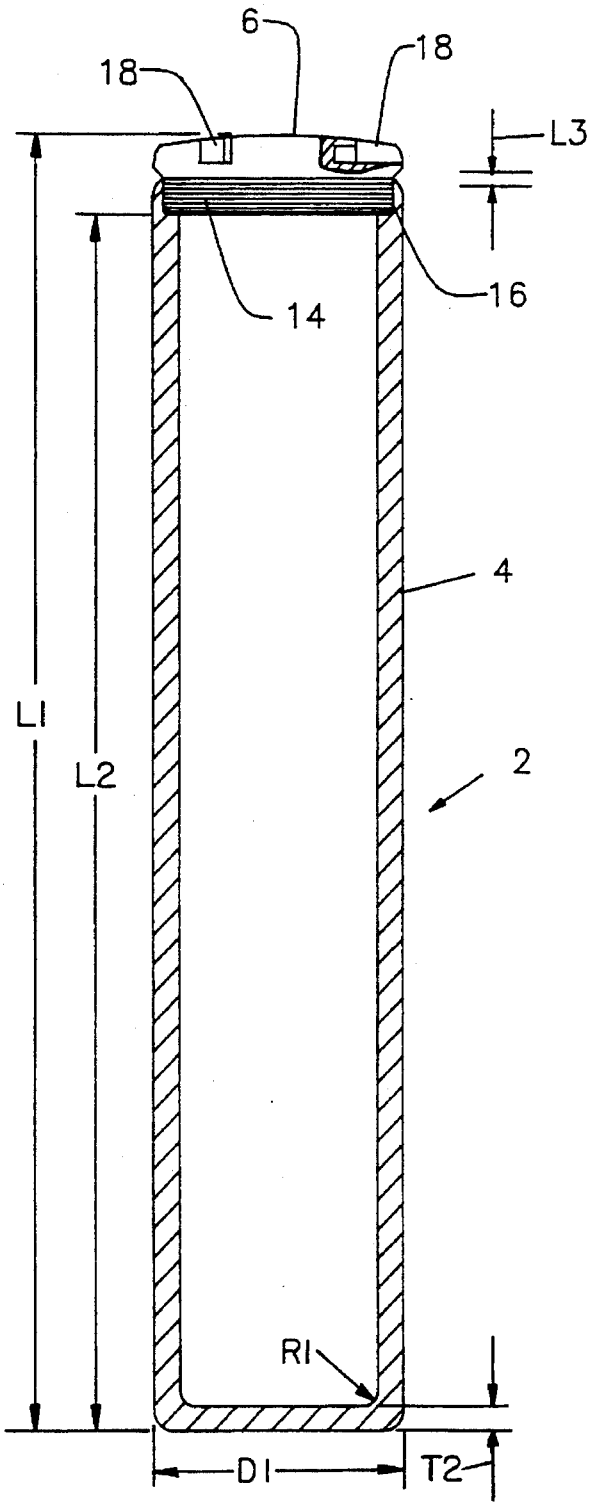
FIG. 2 shows a longitudinal partial sectional view taken along 2–2 of the container of FIG. 1.

In FIG. 2, a partial sectional view is shown of the embodiment of the invention of FIG. 1. The body 4 of container 2 consists of a single-wall, corrosion-resistant metal material. The preferred material provides non-galling properties, suitability for use in high radiation dose environments, and high thermal conductivity. The container 2 and lid 6 are manufactured in the precipitation hardened condition. The present inventor chose the illustrated geometry for the container 2, and for container 12 of FIG. 6, to provide a robust configuration with significant design margin by utilizing high levels of strength, ductility, fracture toughness, and fatigue resistance, for the safe storage of nuclear waste material.

The dome lid 6 of FIG. 1, and cup lid 8 of FIG. 6, provide simple but effective closure designs. As will be described in greater detail below, these closures provide the capability to retrieve and inspect waste materials stored within the bodies 4 of containers 2 and 12, respectively, and reseal them. This is particularly applicable for the dome lid 6 closure preferred for use in storing radioactive waste materials within body 4 at local utilities.

In closing the containers 2 and 12 of FIGS. 1 and 6, respectively, as will be shown in detail below, a mechanical, metal-to-metal seal 32 (see FIG. 4) is provided between the associated lid 6, 8, respectively, and the top inner portion of the associated body 4. Prior to welding, the seal 32 is inspected to insure its integrity. Thereafter, the weld 10 is made to rigidly secure and seal off the lid 6 or 8 as mated to the associated container body 4. After welding, the weld 10 is heat treated. In this regard, the weld filler composition is selected from an age hardenable material that has a heat treatment temperature range which does not alter the characteristics of the material of the body 4 of the associated container 2 or 12, respectively, or the lids 6 or 8, respectively. As will be described in further detail below, the final weld 10 for the storage container 12 is inspectable through use of either or both ultrasonic transmission, and direct x-ray inspection techniques.

Figure 3:
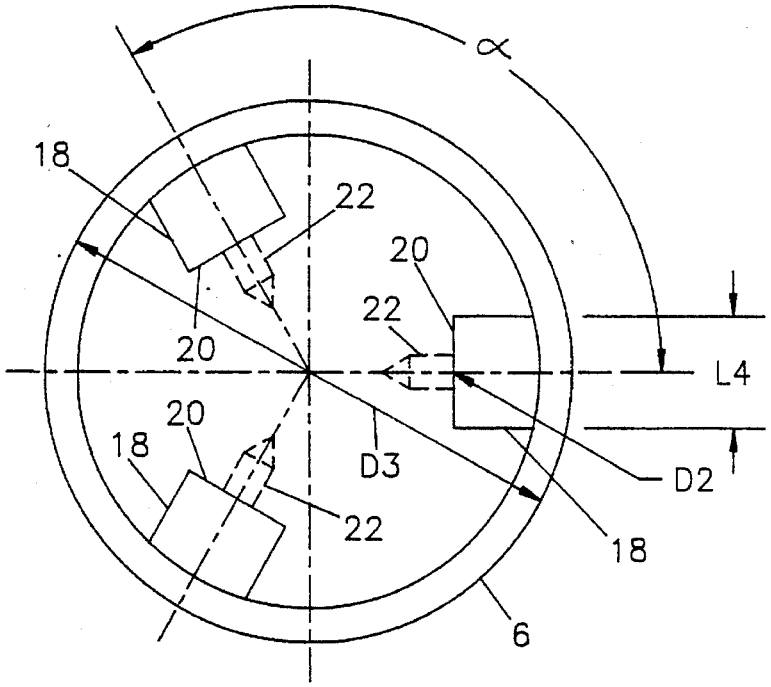
FIG. 3 is a top view of the cap or lid of the embodiment of the invention of FIG. 1.

As shown in FIG. 2, the dome cap or lid 6 is mated to the top portion of the body 4 through use of coarse threads on a lower reduced portion of dome lid 6 screwing into coacting internal threads near the interior top portion of body 4, in this example. With further reference to FIG. 2, in combination with FIGS. 3 and 4, in this example, the length of the container 2 with the dome cap 6 in place is shown as L1, and in one application is expected to be about 185 inches. The length of L2 from the bottom of the dome lid 6 when installed on the body 4 to the bottom of the body 4 is about 180 inches, in this example. The thickness T1 of the sidewalls of container 4 is 1.3 inch. The outside diameter D1 is 24 inches. The thickness T2 of the bottom of the container is two inches, and the radius R1 at the bottom interior circumference of the body 4 is two inches. Note that all dimensions given in this example are for purposes of illustration only, and are not meant to be limiting. Depending upon the application, the dimensions can be set within any practical limit.

The design of the dome lid 6 will now be described in greater detail, with further reference to FIGS. 1 through 4. In this example, three machined slots 18 are included about the top circumference of the dome lid 6 for providing alignment surfaces and torque loading points for use with handling devices. The back walls 20 of each of the slots 18 include a radially aligned horizontal tapered hole 22 from the bottom center portion of the backwall 20 toward the center of the dome lid 6. The width of each of the slots 18, L4, is in this example, 5.0 inches. The backwalls 20 of the slots 18 are located a distance L5 from the center of the dome lid 6, in this example, 6.5 inches. The depth L6 of the hole 20 in this example is 2.0 inches. Also, the rim 24 at the top of the body 4 is shaped to form half of a U-shaped weld channel 26, with the other half of the weld channel 26 being provided by a lower undercut circumferential portion 27 of the dome lid 6, as shown. When the dome lid 6 is screwed completely into mating with the body 4 and the metal seal 28 is compressed, the weld channel 26 so formed has a sweep angle $\beta$ of 20°, in this example. The width L3 of the weld channel opening 26 is 1.0 inch, in this example. Also, the diameter D2 of the tapered holes 22 is 1.5 inches, in this example. The slots 18 are displaced in angle $\alpha$ from one another. In this example, slots 18 are evenly spaced with $\alpha$ being 120°. The distance L7 from the center of the tapered holes 22 to the top center portion of the dome lid 6 is shown as L7, and in this example is one inch. The back walls 20 of each of the slots 18 have a depth L8 of 3 inches in this example. The diameter D3 of the dome lid 6 is in this example equal to the diameter D1 of the cylindrical body 4, which as previously mentioned is 24 inches, in this example.

Figure 4:
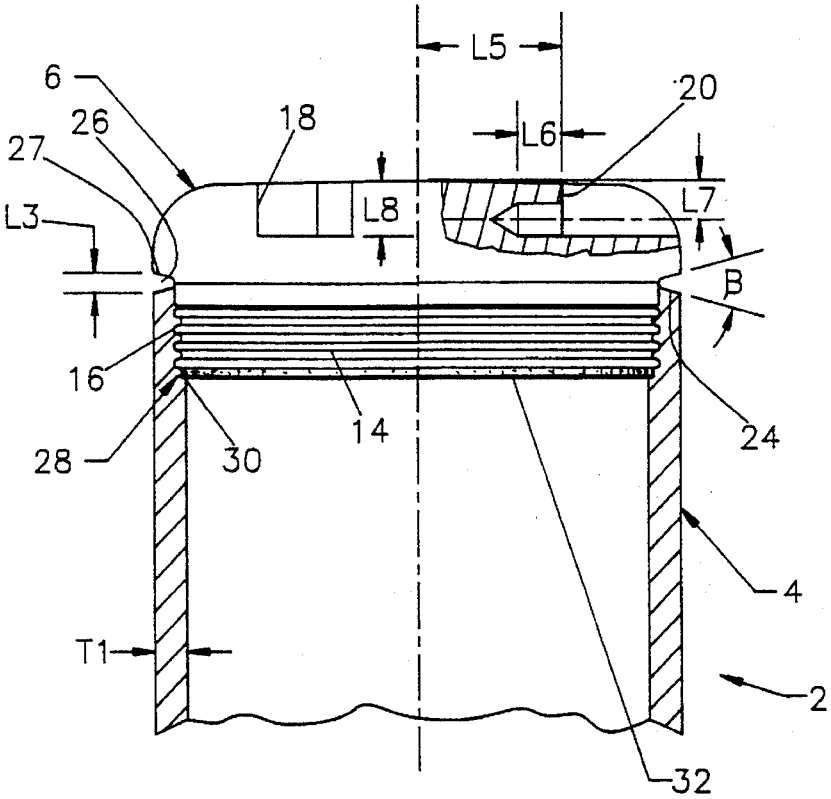
FIG. 4 is an enlarged view of the uppermost portion of FIG. 2 for showing further details of the dome lid.

In FIG. 4, the dome lid or cap 6 is shown fully installed on the body 4. A mechanical seal region 28 is provided between an interior shoulder 30 of body 4 located immediately below the thread 16 at the top interior portion of body 4, for providing one sealing surface. A seal assembly 32, which will be described in greater detail below, is provided between the bottom of the dome lid 6 and the interior shoulder 30 of body 4, as shown.

Figure 5:
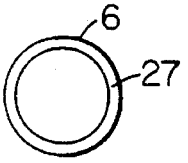
FIG. 5 is a bottom view of the dome lid of FIG. 1.

The dome lid 6 is fabricated from a solid piece of material, in this example. As shown in FIG. 5, the bottom of the dome lid 6 is substantially flat, for providing a proper mechanical interface with the seal assembly 32.

As previously mentioned, the container 2 with dome lid 6 of FIG. 1 is primarily intended for local securing of nuclear waste at a utility site, transport of the nuclear waste, and intermediate term storage of the nuclear waste to a designated site. For long term storage (hundreds of years) of the associated nuclear waste in the body 4, the dome lid 6 is removed from the body 4, waste material may be retrieved, inspected, and/or processed, and afterwards the cup lid 8 installed thereon. Further details of the second embodiment of the invention for providing the container with cup lid 12, will now be described.

Figure 7:
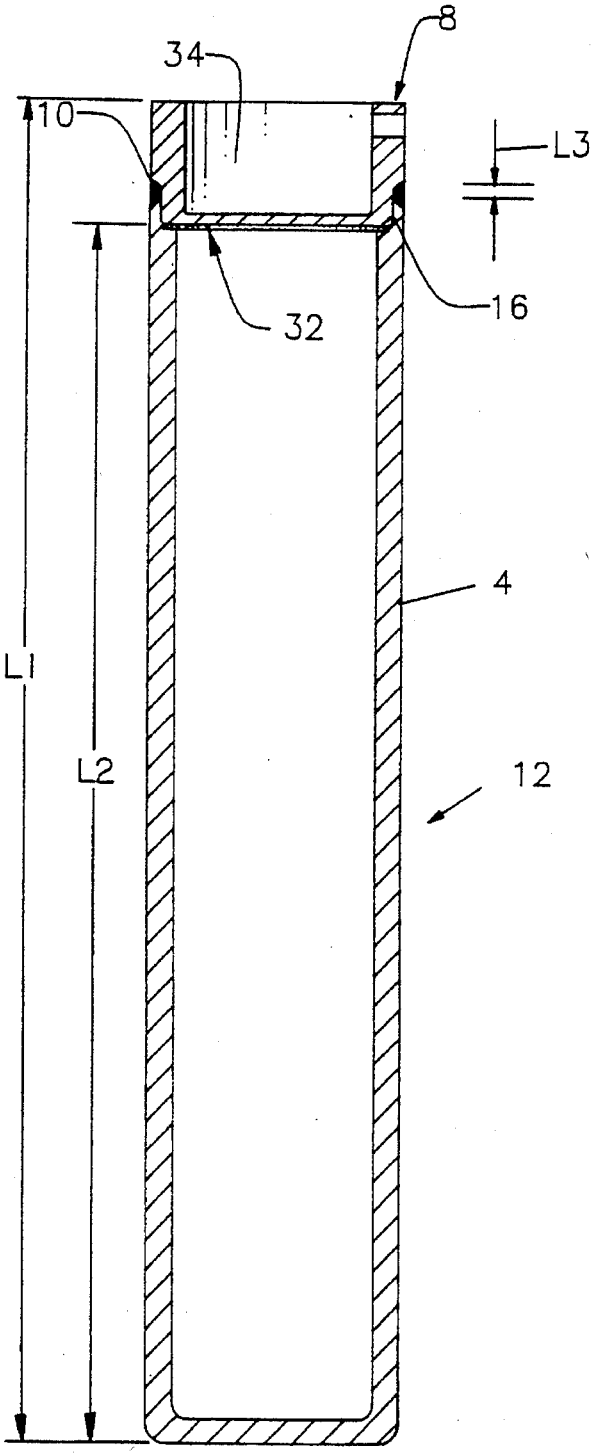
FIG. 7 is a cross-sectional view taken along 7—7 of FIG. 6.
Figure 8:
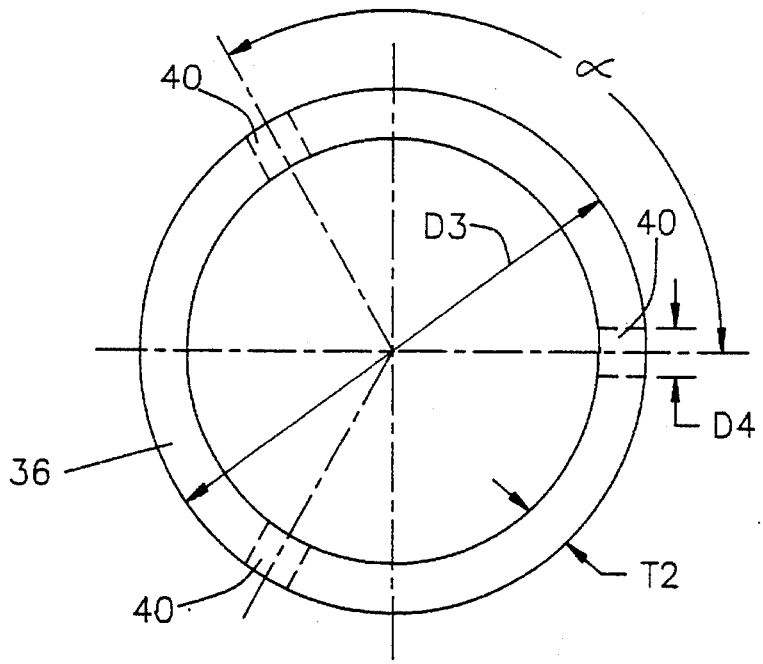
FIG. 8 is a top view of the cup-like lid for the embodiment of the invention of FIG. 6.
Figure 9:
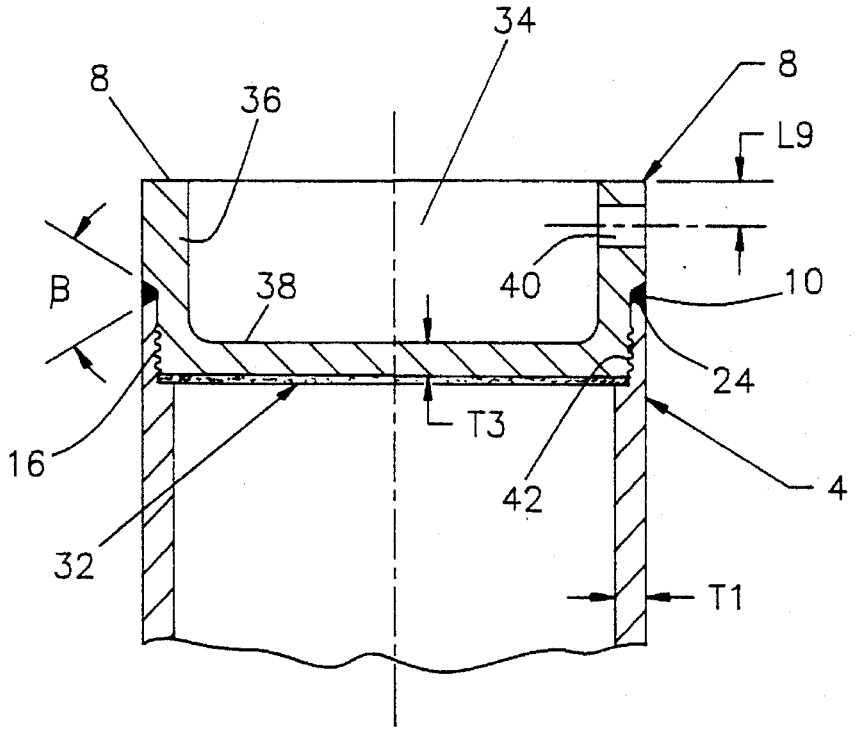
FIG. 9 is a detailed view of the upper portion of the container with lid in place of FIG. 7.

The container with cup lid 12 includes the cylindrical body 4, as previously described. FIG. 7 shows a longitudinal cross section of the container 12 including the cup lid or cap 8 installed on the body 4. As shown in FIGS. 7 through 9, the dimensioning of the cup lid 8 has been designed to conform to the greatest extent possible to the dimensioning and angular configurations associated with the dome cap 6. The cup lid 8 includes a cylindrical well portion formed by vertical sidewalls 36, and a bottom portion 38. The side walls 36 have a thickness T2 of 1.3 inches, whereas the bottom portion 38 has a thickness T3 of 1.3 inches, in this example. Note that the diameter D3 of cup lid 8 is identical to that of the dome lid 6, 24 inches, in this example. Also in this example, three through holes 40, each having a diameter D4 of 2 inches, in this example, are located in the side wall 36 in radial orientation displaced an angle $\alpha$ from one another ($\alpha$ is 120° in this example). The center of each of the through holes 40 are located a distance L9 from the top edge of the cup lid 8. In this example, L9 is 2.5 inches. As with the dome lid 6, the weld 10 is provided for securing the cup lid 8 to the body 4. The bottom or lower narrowed portion of the cup lid 8 includes threads 42 for mating with the interior thread 16 of body 4. For design compatibility, and for lid interchangeability, the lower reduced outside diameter portion of the cup lid 8 is in the preferred embodiment substantially identical to the lower portion of the dome lid 6. Accordingly, in the preferred embodiment, the bottom view of the cup lid 8 is identical to the bottom view of the dome lid 6, as shown in FIG. 5. Note also that the handling apparatus for installing or screwing the cup lid 8 into the body 4 will have different design configuration details for the handling apparatus for installing the dome lid 6 into the body 4. The handling apparatus will, in either case, in addition to providing for installing and removing the lids 6 and 8, respectively, from the body 4, be capable of also lifting the containers 2 and 12 with their associated caps or lids 6 and 8 and contents, respectively. Further details of such apparatus is given below.

Figure 10:
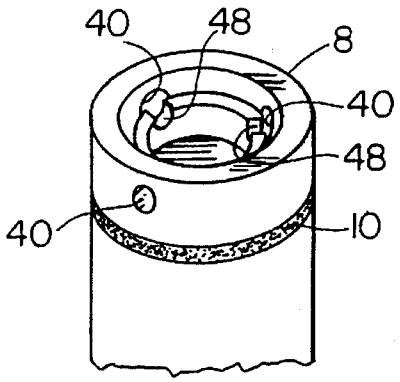
FIG. 10 is a pictorial drawing showing details of an indexing track associated with the cup lid of the embodiment of the invention of FIG. 6.

The present inventor anticipated that an inspection tool or apparatus must be designed to facilitate rapid and remote inspection of the weld seal 10 between the cup lid 8 and body 4. The cup lid 8 includes, as shown in FIG. 10, holes 40 also providing position references. The position reference holes 40 provide a means for permitting an inspection apparatus to determine its location on the cup lid 8, that is its angular position from a datum point, for permitting identification of each portion of the weld 10 that is either x-rayed or inspected by ultrasound, or some other known inspection technique. The track 44 also provides defect calibration for various flaw sizes and depths. In this manner, the condition of the weld 10 from one inspection to another can be compared, and any defect in any portion of the weld 10 can readily be characterized, to permit appropriate analysis and repair.

Figure 11:
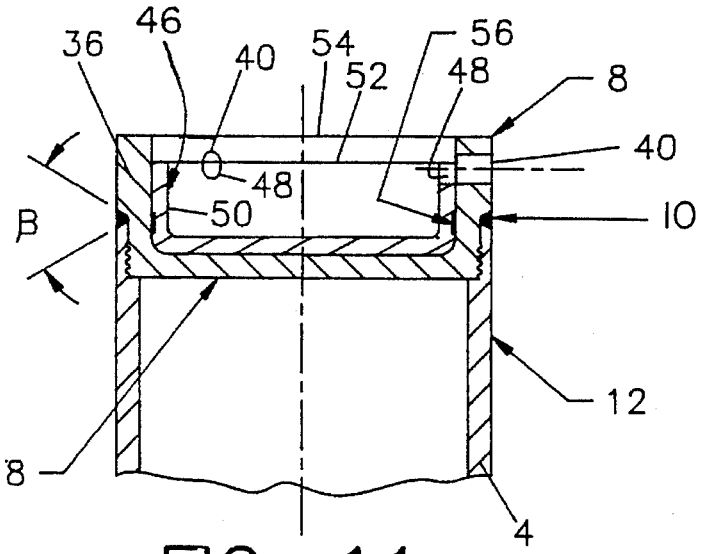
FIG. 11 shows a cross-sectional view of an X-ray film retainer and shield for use with the cup-lid configuration of FIG. 9.

In a further embodiment of the invention, for facilitating periodic inspection of the weld 10, a cup-like insert 46 (see FIGS. 11 and 12) is dimensioned to frictionally fit within the cylindrical weld 34, against the mechanically indexed inside surface of the circular sidewalls 36 of cup lid 8. Partial circular through holes 48 are provided through the sidewall 50 of insert 46, for alignment with and as a continuation of the holes 40 of cup lid 8. In this manner, the through holes 40 are not blocked by the insert 46, for permitting an appropriate handling tool to be utilized with the container 12 having the insert 46 in place in cup lid 8. In this example, the top edge 52 of insert 46 is below the top edge 54 of cup lid 8. A shallow band-like channel 56 is formed about the circumference in the lower portion of the outside surface of sidewall 50 of the film insert 46. The purpose of the channel 56 is to retain x-ray film 58 of FIG. 12 in facing the circumferential weld 10 located on the opposite side of the sidewall 36 of cup lid 8. As a standard industrial radiation source is rotated about the cup lid 8 or alternatively as the container is rotated and the radiation source remains stationary, x- rays are directed through the weld 10 for exposing the film 58, to provide both an indication of the condition of the weld 10, locations, indices and calibration defects, and a permanent record of each inspection made thereof, as a basis for comparison with previous or subsequent films 58 produced during prior or subsequent inspections.

The present closure design in its various alternative embodiments, as discussed in greater detail below, provides a simple, underwater (in the spent fuel storage pool) or hot cell assembly sequence, while retaining the capability to retrieve and inspect the hazardous waste material stored within the body 4, particularly with regard to the embodiment of container 2 for securing and storing radioactive waste material at a local utility. In this example, the closure sequence for either of the containers 2 or 12 is initiated by installing either the dome lid 6 or cup lid 8 onto the body 4, and insuring that the lids 6 or 8 are screwed tightly down against the seal assembly 32, for producing a tight mechanical, metal-to-metal seal. The integrity of the mechanical, metal-to-metal seal must then be inspected using either UT or trace gas techniques, whereafter the weld 10 is applied, followed by post weld heat treating. In the preferred embodiment, as discussed in detail in the previously referenced co-pending application Ser. No. 07/951,209, the weld process utilizes a weld filler composition for weld 10 which is age-hardenable at a temperature below the kinetic threshold temperature of the material of containers 2 and 12 and chemically comparable to material to be joined. Accordingly, heat treatment of the weld 10 does not alter the physical characteristics of the material of containers 2 and 12 and respective covers. Such heat treatment of weld 10 enhances the closure weld properties of the weld 10, and provides for making the physical electrical and thermal properties of the material of the weld 10 substantially comparable with the material of the dome lid 6 or cup lid 8, and body 4. As will be discussed in greater detail below, the weld closure sequence and heat treatment process uses known, demonstrated welding techniques.

In the example of storing nuclear waste or radioactive waste material, the preferred material for containers 2 and 12, respectively, is copper-beryllium. The body 4 can be fabricated by either extrusion or casting of the chosen material. In this regard, the preferred copper-beryllium alloys exhibit excellent extrusion and casting characteristics. Otherwise, standard fabricating techniques are used in producing containers 2 and/or 12. The combination of the mechanical seal assembly 32, and weld 10, provide for a high reliability metal-to-metal seal consistent with high vacuum applications. As will be discussed below, the weld channel 26 provides for a weld zone of high mechanical integrity, using a demonstrated automatic welding procedure.

A number of different seal assembly 32 configurations have been designed for use with the container configurations 2 and 12 of the present invention. These seal assembly 32 configurations are considered alternative embodiments of the invention. Each of the seal assembly 32 configurations has specific advantages depending on the particular waste and storage/process applications. A detailed description of each of the three alternative seal assembly 32 configurations follows below.

Figure 13:
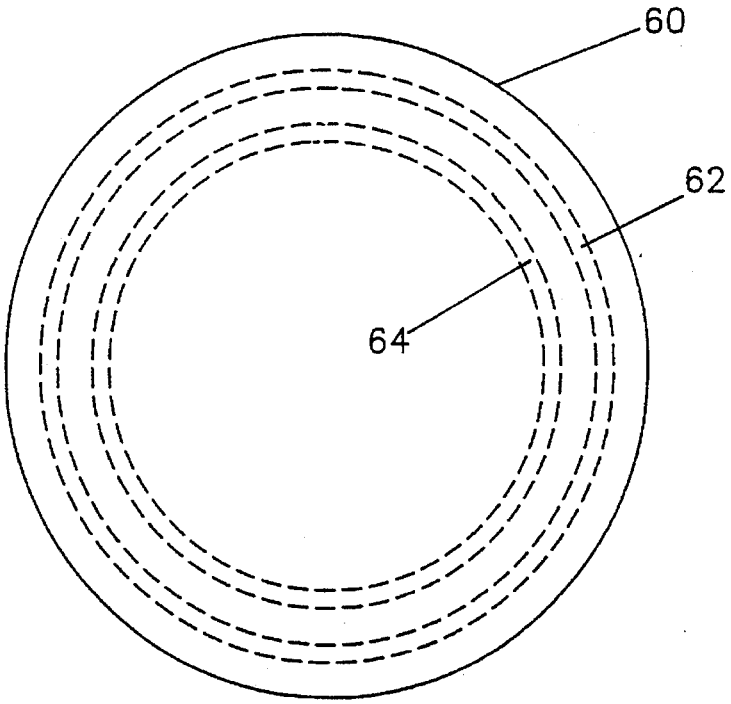
FIG. 13 is a top view of an "O"-ring and disk assembly composing one of the metal seals of one embodiment of the invention.

A first embodiment for seal assembly 32 is shown in FIGS. 13 through 16. In this embodiment, a double-metal "O"-ring design includes a metal disk 60 which can be composed of stainless steel, in this example, which has mounted on a bottom side two concentric "O"-rings consisting of an outermost "O"-ring 62, concentric with an inner "O"-ring 64. As shown in FIG. 13, a top view of this seal assembly 32 shows a flat top surface or disk 60, and a bottom view (see FIG. 14) of this assembly shows the positioning of "O"-rings 62 and 64 on the bottom 68 surface of disk 60. Both this seal assembly 32, and the alternative two embodiments described below, were particularly designed to be compatible with remote manipulator techniques, and for providing metal-to-metal seals of high vacuum integrity. The disk 60 acts as a bearing surface in mating with the bottoms of the lid 6 or 8, as the lid is torqued into position. Also, the disk 60 provides a metallic barrier, sealing the container contents. Typically, this seal assembly 32 for providing a double "O"-ring seal is fabricated by plastically deforming the welded/metallic "O"-rings 62 and 64 such that each has a continuous flat surface. The "O"-rings 62 and 64 are then annealed and welded to disk 60.

Figure 15A:
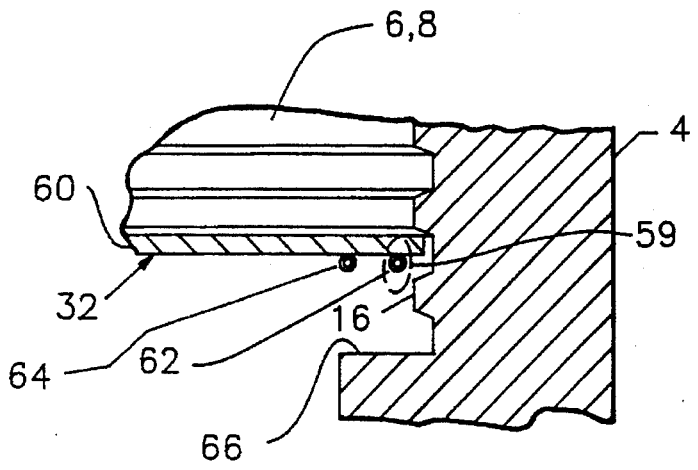
FIG. 15A is a partial sectional view showing details of the metal "O"-ring and disk assembly positioned away from an associated mating shoulder or sealing surface of the main cylindrical body for the various embodiments of the invention.
Figure 15B:
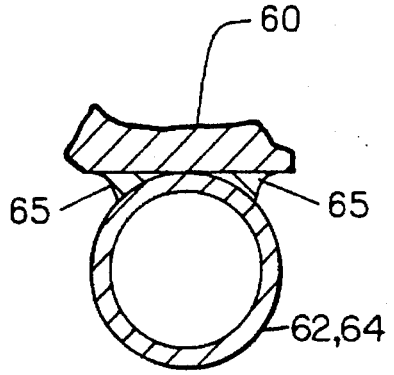
FIG. 15B shows a detail view of a portion of FIG. 15A.
Figure 16:
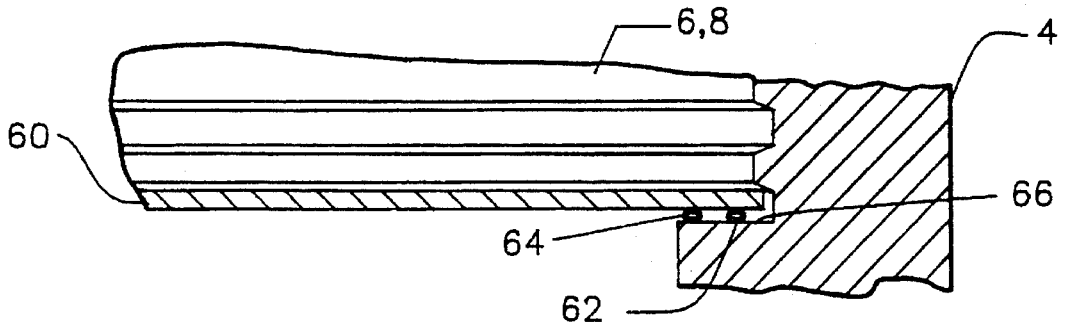
FIG. 16 shows the metal "O"-ring and disk assembly with the "O"-rings engaging a shoulder portion of an interior wall of an associated container, for one of the metal seals of one embodiment of the invention.

In this example, disk 60 is about 0.5 inch thick. The resultant seal assembly 32 is shown in FIG. 15A in the process of being screwed down by a lid 6 or 8 into position within body 4, whereby the bottom surfaces of "O"-rings 62 and 64 rest upon the top interior rim or shoulder 66 of body 4. As shown in FIG. 15B, a weld 65 is used to secure the "O"-rings 62, 64 to disk 60. Shoulder 66 is fabricated to be sufficiently flat for providing a good seal with the mating surfaces of "O"-rings 62 and 64. Also, shoulder 66 and the mating flat of the "O"-rings 62 and 64 are plated with an appropriate metal, such as silver, for example. In FIG. 16, the resultant sealing mechanism is shown, whereby the associated lid 6 or 8 has been screwed tightly down into body 4, causing compression of the "O"-rings 62 and 64 into the plastic regime, thereby establishing a metal-to-metal vacuum quality seal. Initially, when the associated lid 6 or 8 is torqued or screwed into the body 4, the seal assembly 32 of this example experiences circumferential and compressive loading. When the "O"-rings 62 and 64 come into hard contact with the surface of shoulder 66, specifically when the plated surfaces engage, the circumferential motion of the "O"-rings 62 and 64 stops, and slip occurs at the interface between the bottom of the associated lid 6, 8 where it contacts the top of the disk 60. This action causes pure compressive loading of the "O"-rings 62 and 64 into the surface of shoulder 66 without any rotational component, causing the latter to be compressed into the plastic range of the "O"-ring material and the "O"-ring plating thereof and the silver plated surface of the shoulder 66, in this example. It should be noted that the associated seal surfaces require protection from mechanical damage during the loading of waste material into body 4.

Figure 17:
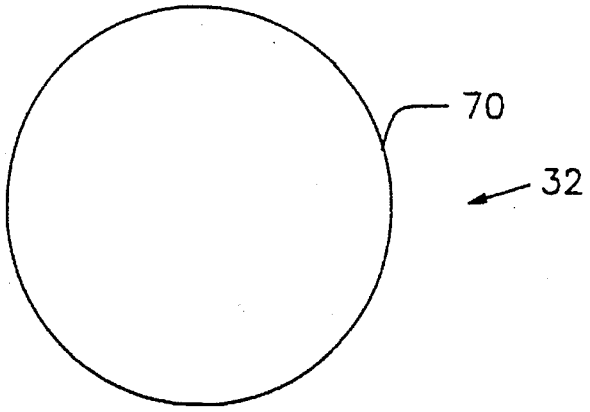
FIG. 17 shows a top view of a temperature triggered sealing disk of one of the metal seals of one embodiment of the invention.
Figure 18:
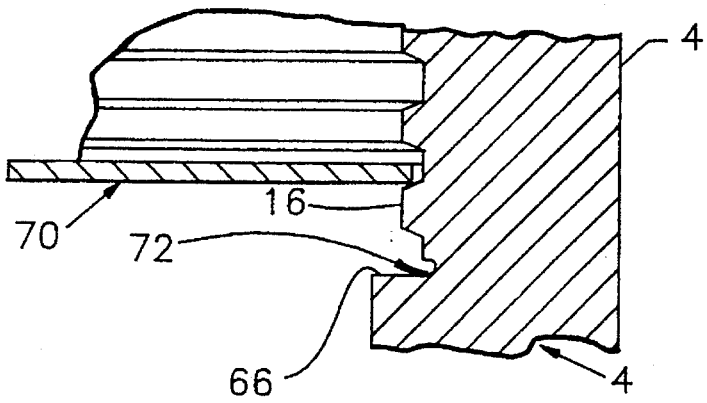
FIG. 18 shows a partial sectional view of the sealing disk of FIG. 17 prior to an associated lid being screwed down to deliver the disk to the seal plane of an associated container.
Figure 19:
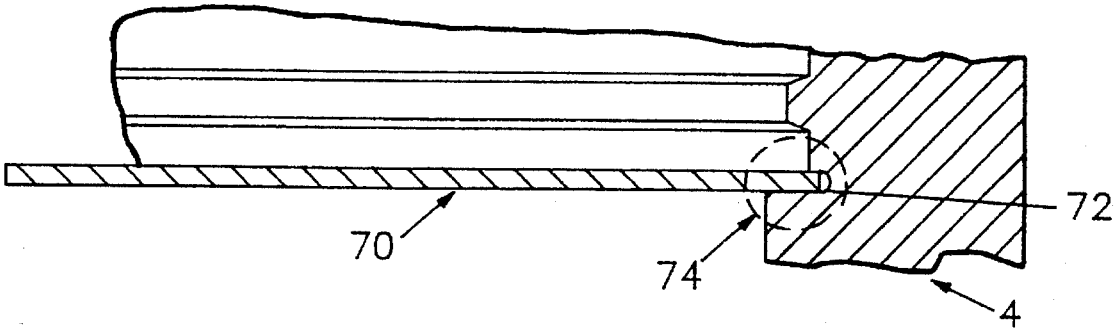
FIG. 19 shows the sealing disk of FIG. 18 in the seal plane with the seal disk yet to be triggered into position against the shoulder or rim of the associated container.
Figure 20:
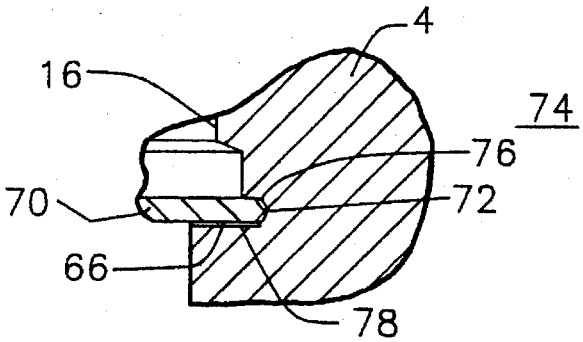
FIG. 20 shows a detailed partial sectional view of a portion of FIG. 19 with the seal disk triggered into the shape and size required for sealing.
Figure 21:
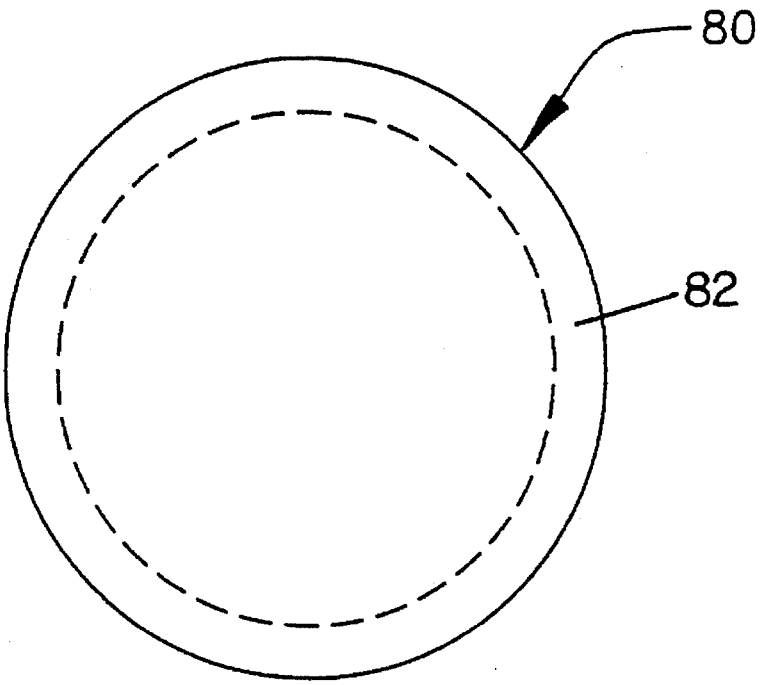
FIG. 21 shows a top view of a laminate seal for one of the metal seals of another embodiment of the invention.
Figure 22:
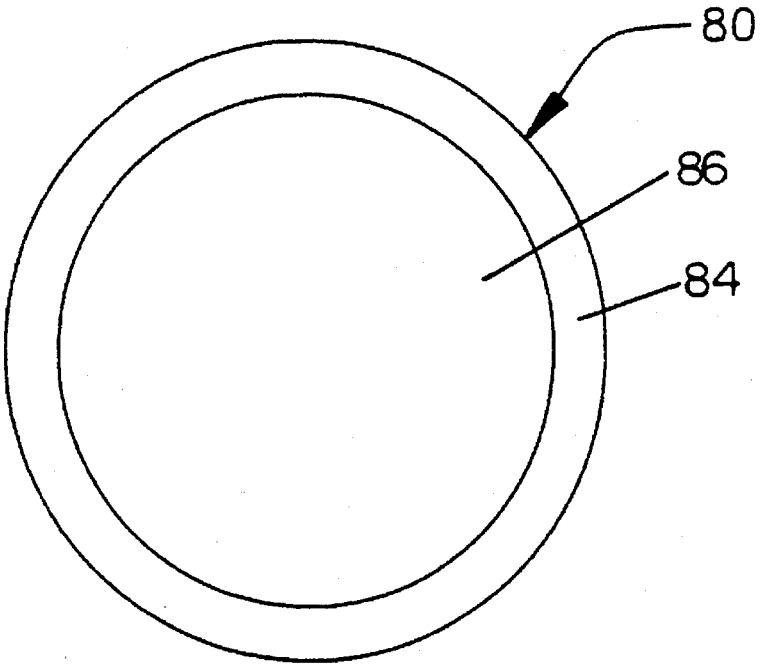
FIG. 22 shows a bottom view of the laminate seal of FIG. 21.

The seal assembly 32 is provided in another embodiment of the invention by a temperature triggered seal as shown in FIGS. 17 through 20. In this embodiment, a sealing disk 70 of material such as nickel titanium (NiTi) provides the seal assembly 32, in this example, in combination with a semicircular groove 72 located proximate to the shoulder 66 of body 4. As shown in FIGS. 18, 19, and 20, the groove 72 is cut into the inner sidewall of body 4 below the thread 16 and immediately above the shoulder 66, for forming a circumferential groove 72 juxtaposed to shoulder 66. The top and bottom views of the sealing disk 70 are shown in FIG. 17, and are identical, in that the sealing disk 70 is provided by a circular disk with radiused edge, in this example. The diameter of sealing disk 70 is initially made slightly smaller than the diameter of thread 16, for permitting sealing disk 70 to be delivered to the shoulder 66 region in the envelope of the threads 16 upon installation of either dome lid 6 or cup lid 8 onto body 4. Note that the shoulder 66, can be made narrower than otherwise required for other sealing embodiments of the invention described herein for providing seal assembly 32. In this embodiment, shoulder 66 need only be wide enough to retain sealing disk 70 once the associated lid 6 or 8 has been rotated into a maximum downward position upon body 4. Heat is then applied to the dome lid 6 or cup lid 8 proximate to the sealing disk 70, for transferring heat to sealing disk 70 to temperature trigger the NiTi material into radial expansion, causing the sealing disk 70 to expand into the semicircular groove 72 of the inside wall of body 4, as previously described. FIG. 19 shows sealing disk 70 just prior to temperature triggering. The detailed view 74 shows sealing disk 70 after thermal expansion, whereby it has expanded into circular groove 72, centered on the semicircular portions of circular groove 72, as shown in FIG. 20. Note that the sealing disk 70 expands in such a way that it forms a perimeter seal with circular groove 72 effectively comprising two seal rings, one at the corner 76 or upper edge 76 of groove 72 relative to shoulder 66, and the other seal ring being formed between disk 72 and the surface of shoulder 66 slightly before groove 72 at about region 78. In this manner, the seal ring regions formed at 76 and 78 provide a metal-to-metal, high quality vacuum seal. Note that as a result of the seal ring 78 being so formed, in practice there will be a very small gap between the bottom of disk 70 and a substantial portion of shoulder 66, as shown in FIG. 20. The lid 6 or 8 has been rotated into a maximum downward position with the final position set by the closing of the weld channel opening L3 (see FIG. 4), a position which results in a closed gap weld preparation and the delivery of the sealing disk 70 to a position slightly above the container shoulder 66 of body 4.

Figure 23:
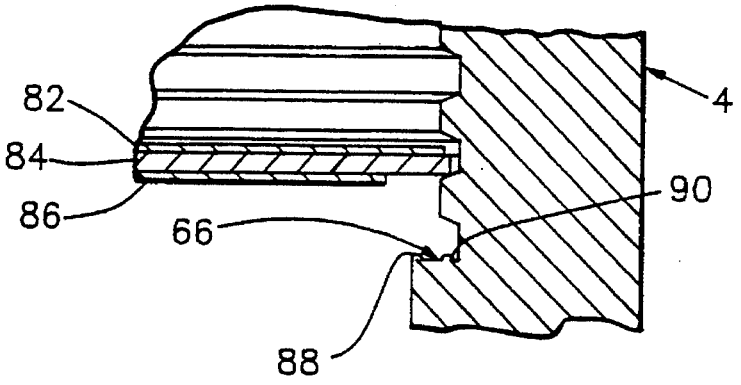
FIG. 23 shows a partial sectional view of the laminate seal of FIG. 21 before compression in relation to its associated lid or cap and cylindrical container.
Figure 24A:
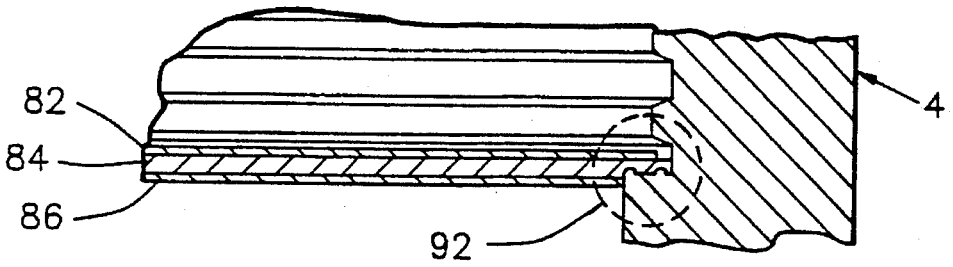
FIG. 24A is a partial sectional view showing the laminate seal of FIG. 21 in compression relative to its positioning with its associated lid and the rim or interior shoulder of the associated container.
Figure 24B:
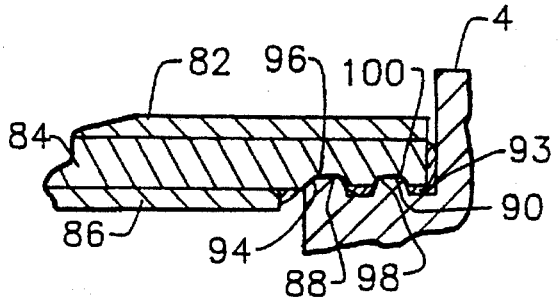
FIG. 24B is a detailed view of a portion of FIG. 24A.

Seal assembly 32 can also be provided in a third sealing embodiment of the invention as shown in FIGS. 21 through 25. In the example of this embodiment, a three layer metallic laminate seal disk 80 is provided by a top layer 82 of UNS 7718 (a nickel based alloy), a middle layer 84 of UNS C10700 material (a copper alloy), and a bottom layer 86 of UNS 7718 material. Other metal combinations can be used. The material of the top layer 82 is in its age hardened condition, whereas the material of middle layer 84 is in an annealed condition. In this embodiment, two concentric ridges 88 and 90 are formed in a circle and protrude from the top of shoulder 66, as shown in FIG. 23, for example. Note that the top layer 82 of laminate sealing disk 80 acts as a slip surface between the rotating lid and seal disk. This results in the seal disk 80 experiencing compression into the ridges 88 and 90 without rotational transform. The bottom laminate layer 86 is included to provide planar rigidity to the structure of laminate seal disk 80. The laminate seal disk 80 is attached to the lid 6 or 8 by a weak adhesive, for example, and is moved downward into sealing position by the rotation of the lid (either 6 or 8), whereby as the associated lid 6 or 8 is screwed down into the to of body 4, the bottom surface of the associated lid abuts against the top of layer 82 of sealing disk 80. When the lid 6 or 8 is rotated into body 4 into its downwardmost positioning therein, the ultimate torquing of the associated lid causes the ridges 66 and 88 to plastically deform the annealed copper center layer 84 of sealed disk 80, for forming at least four circumferential metal-to-metal seal boundaries, as shown in FIGS. 24A and 24B. A detail of the sealing region 92 shown in FIG. 24A (in phantom) is shown in FIG. 24B with plastically deformed copper 84 highlighted. It is preferred that the ridges 88 and 90 have a trapezoidal shape as shown. As a result of such shaping, when the associated lid 6 or 8 is torqued into the top of body 4, the center copper layer 84 undergoes plastic deformation as indicated by the narrow cross-hatched areas 93, thereby forming four circumferential metal-to-metal seals at the two top corners of each of ridges 88 and 90. As shown, the ring seals are formed at the ridge corners 94, 96, 98, and 100.

Figure 25:
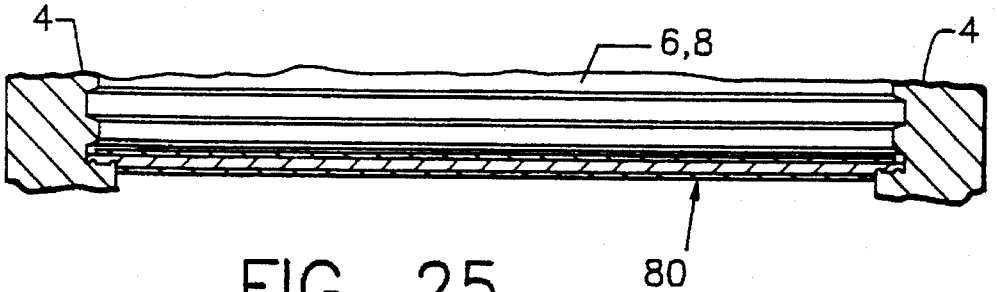
FIG. 25 is a partial sectional view across the width of a portion of the associated cylindrical container and lid showing the laminate seal in compression.

Note that the inner ridge 88 is formed about the top edge of shoulder 66, whereas ridge 90 is formed radially outward of this inner ridge, concentric with and spaced away from ridge 88. FIG. 25 shows a full cross-sectional view through the center longitudinal axis of either container 2 or 12, when using the laminate seal disk 80. Also note that in this example, layer 86 is 0.1 inch thick, layer 84 is 0.2 inch thick, and upper layer 82 is 0.1 inch thick. Different applications may require different thicknesses, and the example of the thicknesses provided are not meant to be limiting. The laminate seal, as well as other seal designs may be resealed a number of times. This is an important feature when inspection and retrievability are design goals.

Note that as the associated lid 6 or 8 and laminate seal disk 80 are delivered to the seal region by screwing in the associated lid, the mechanical loading at the interface between top layer 82 and center layer 84 is a combination of circumferential motion and surface compression. Ultimately, as torquing of the lid 6 or 8 continues, there is contact between layer 82 and the ridges 88 and 90, resulting in plastic deformation of the annealed copper layer 84, whereby the torquing component of the loading at the 84/88–90 interface ultimately terminates, and compressive loading then dominates. The top layer 82 interface with copper layer 84 becomes a slip surface to the rotating lid 6 or 8.

Note further that the diameter of upper layer 82 and center layer 84 of laminate seal disk 80 is slightly smaller than the inside diameter of threads 16. The bottom layer 86 has a diameter that is slightly smaller than the inside diameter of the main portion of body 4.

Figure 26:
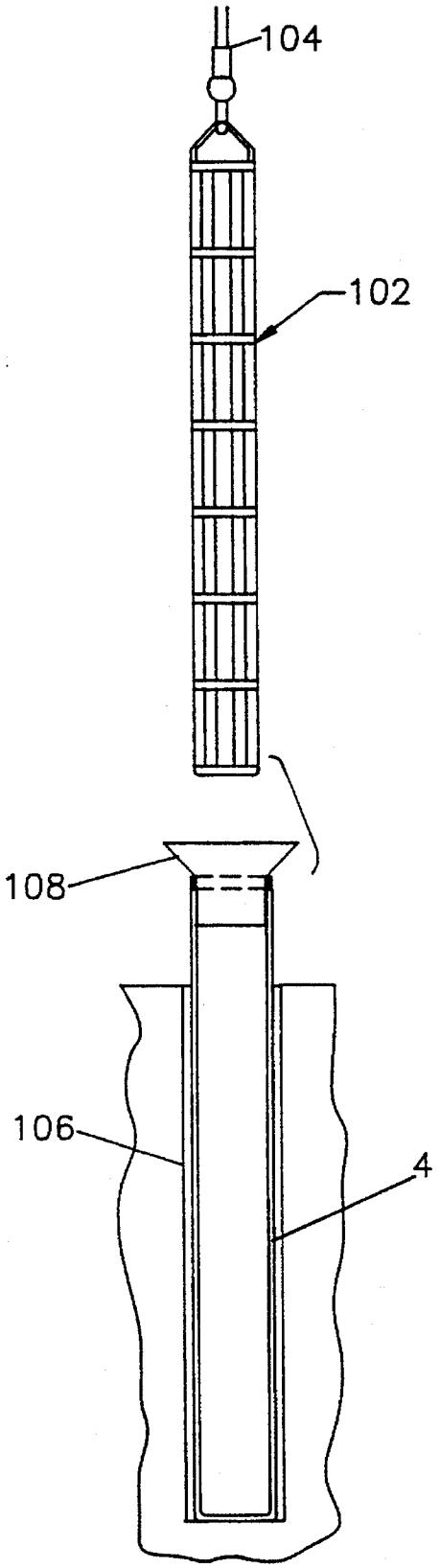
FIG. 26 is a front elevational view showing an example of high-level radioactive waste loading of a container for one embodiment of the invention.
Figure 27:
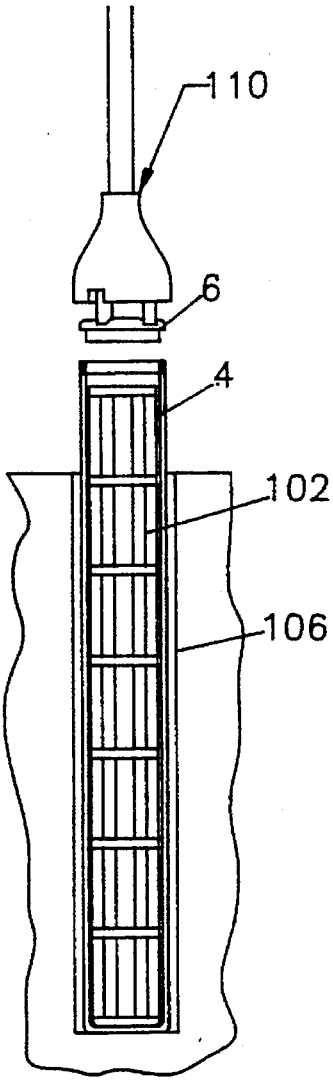
FIG. 27 shows a handling apparatus in the process of installing a dome lid on an associated container for one embodiment of the invention.

The loading of body 4 with a nuclear spent fuel assembly 102 is shown in FIG. 26. A crane hook 104 is used to position the fuel assembly 102 over the top opening of the body 4. In this example, the body 4 is shown substantially enclosed within a pit or pool immersed in the spent fuel storage water 106. Also in this example, a protective funnel guide 108 is installed in the top of body 4, as shown, for protecting the threads 16, and the seal area including shoulder 66. The funnel guide 108 guides the fuel assembly 102 into body 4 as the former is lowered via crane hook 104. A significant advantage of this concept is the reduction in personnel radiation exposure. The spent fuel assemblies 102 may be loaded into the body 4 and sealed under water or in a hot cell, both significantly reducing exposure.

The next operation to be performed is to use a dome lid handling tool 110 to carry a dome lid 6 to body 4 (see FIG.

Figure 28:
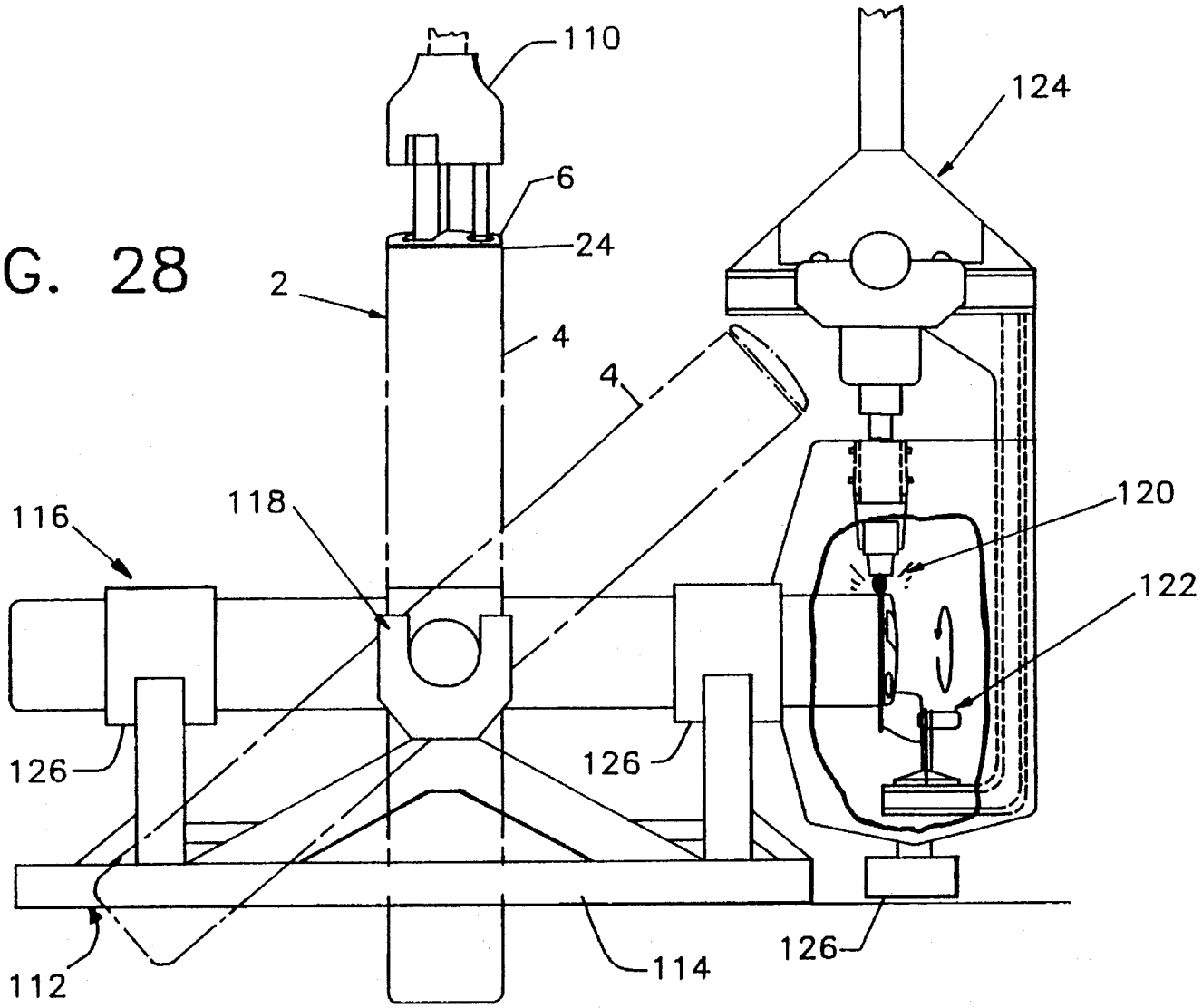
FIG. 28 is a simplified front elevational view of a positioning-rotating-welding system for welding lids and grinding the weld bead for elongated cylindrical containers for various embodiments of the invention.

27), and to thereafter screw the dome lid 6 which contains the appropriate seal assembly 32, into the top of body 4. Although a dome lid 6 is shown in this example as being installed, for the long term storage configuration of FIG. 6, the cup-lid 8 would be installed instead of dome lid 6. The handling tool 110 provides the torquing required for the metal-to-metal seal, and then is used to carry the container 2 via interaction with dome lid 6 to automated welding apparatus 112 (see FIG. 28), for welding dome lid 6, in this example, to body 4.

The welding apparatus includes a base member 114, upon which a container rotational index table 116 is mounted. The container 2 is first vertically lowered into position via handling tool 110, for retention in a rotatable (vertical to horizontal) holder assembly 118. Once secured to the holder assembly 118, container 4 is then rotated from vertical alignment to horizontal alignment with the weld groove positioned between an automated welder head 120 and an automated weld surface grinder 122 of an automated welding apparatus 124. Welder head 120 is retained in an arc down position. A rotational mechanism (not shown) is included on container index table 116 for rotating body 4, as automated welding is carried out for installing the weld 10. After the installation of the capping pass and a review of the weld quality, the weld bead is ground flush by 122. Note that an air filtration system 126 is included with the welding apparatus 124 for venting welding vapors and filtering particulate generated during welding and grinding.

Figure 33:
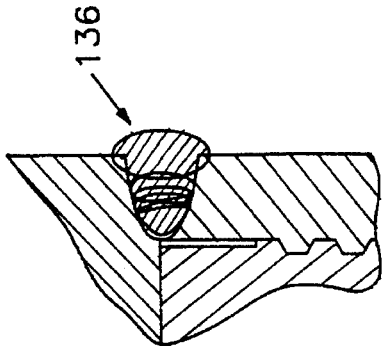
FIGS. 29 through 33 show a weld-pass sequence for joining either dome or cup lids to container bodies of various embodiments of the invention, with these figures showing a single bead composed of a root pass, first fill pass, second fill pass, third fill pass, and capping pass, respectively, with the pass-to-pass penetration indicated.
Figure 32:
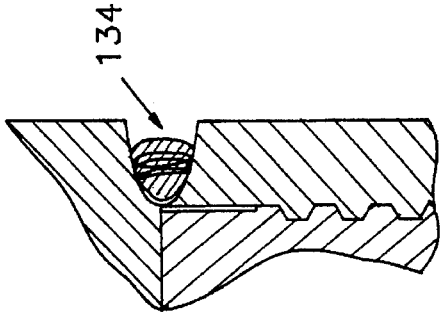
Figure 31:
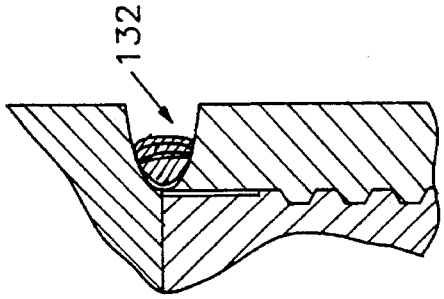
Figure 30:
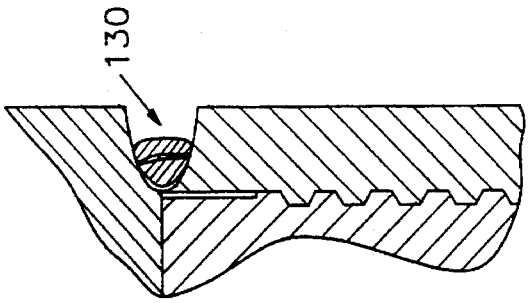
Figure 29:
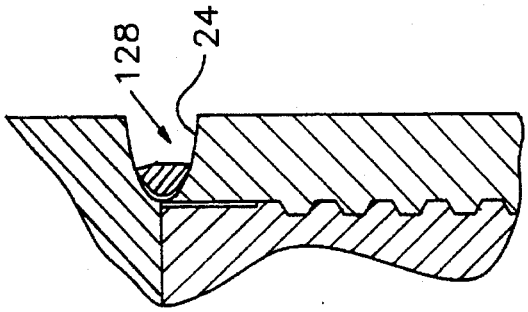

The weld 10 is applied in a multiple number of passes but single bead as shown in FIGS. 29 through 33. The initial rotation of container 2 or 12, in this example, is made for installing a root pass weld 128 in weld groove 24, as shown in FIG. 29. This pass is scheduled for deep penetration into parts 6 or 8 and 4. Part 4 rotation is continuous for the five passes. The second 360° rotation is for installing a first fill pass weld bead 130, as shown in FIG. 30. This is followed by three successive 360° rotations of container 2, for applying a second fill weld 132, third fill weld 134, and a capping pass 136, as shown in FIGS. 31 through 33, respectively. After the capping weld 136 is applied, and weld inspection is completed, grinder 122 is operated to grind the capping weld flush with the outside diameter of body 4. This process both enhances the mechanical properties of the weld allowing more reliable weld inspection, and produces surface residual compression in the weld bead 10. Note that the weld 10 so formed is a continuous weld bead, as a result of performing the welding operation in one step through five successive 360° rotations of container 2 or 12, in this example. Such rotation is accomplished by use of an index table in welding apparatus 124, for providing a programmed torch head or welder head 120 travel rate relative to the rotating container 2 or 12, regardless of the radial position of the associated weld pool. The automated welding controller addresses all weld process parameters including arc travel speed, arc voltage, arc current, wire feed rate, and arc shield gas flow. The automated welding apparatus 124 is remotely controlled and equipped with an arc/weld pool viewing and recording system. The viewing system has an optical field which includes portions of both the associated lid 6 or 8, and body 4, in order to record part serial numbers and key reference positions for the lid 6 or 8 and body 4. While these features are not shown in detail, it is anticipated that the field of view will record the weld pool, the solidified weld bead, and the upcoming weld preparation area or prior weld pass bead. In this example, it is expected that a video tape record will be made of the 375-inch long weld pass, an important supplement to the ultrasonic transmission and x-ray weld inspections. Note also that the arc down welding position of welder head 120 optimizes the welding process by maximizing the arc mass transfer rate, enhancing the stability of the plasma arc, and allowing optimum solidification of the weld pool.

In the preferred embodiment, the weld 10 is applied in accordance with the teachings of co-pending application Ser. No. 07/951,209, filed on Sep. 25, 1992, for "Method and Apparatus For Welding Precipitation Hardenable Materials". Accordingly, body and dome lid 6, and cup lid 8, are fabricated from copperberyllium alloy UNS C17510. The weld filter material is preferred to be copper-beryllium alloy UNS C17200. Copper beryllium alloy UNS C17510 is an age-hardenable, high strength/high thermal conductivity composition of a nominal 0.5 weight percent beryllium and 2 weight percent nickel. Copper beryllium alloy UNS C17200 is also age-hardenable, and has high strength/high thermal conductivity, but this alloy also contains a nominal 2 weight percent beryllium. Precipitation age hardening is a processing procedure where deliberately shaped and distributed precipitation is triggered in the solid phase to enhance the properties of the material. The physical property enhancement is typically not directional, and improves fatigue strength and thermal and electrical conductivity.

These materials were further chosen for the preferred embodiment, in this example, in that C17510 is a well characterized alloy exhibiting an elastic modulus of the order of 20 million psi, a thermal conductivity of 140 Btu/(ft. hr. °F.), and a melting temperature greater than 1,900° F. Also, copper beryllium alloys can be readily forged, extruded, and cast. The alloy also is resistant to stress relaxation and corrosion at elevated temperatures and under severe environments. Also, copper-beryllium is non-sparking, non-magnetic, and non-swelling under high radiation dosage. These alloys are also characteristically non-galling, provide high fracture toughness, impact strength, tensile strength, fatigue life under a wide range of R conditions, compressive strength, broad operating temperature range, excellent electrical and thermal conductivity, and excellent heat capacity and thermal diffusivity. As a result of all of these characteristics, this alloy material is considered preferred for providing the intermediate storage container 2 embodiment of the invention with the ability to be mechanically sealed with a metal-to-metal, high quality vacuum seal, yet reopened for inspection or the addition of more waste, without undue effort or deterioration of the integrity of the container 2. In addition, the welded configuration may be opened and resealed.

Also, the copper-beryllium alloy of the preferred embodiment provides an element of self-shielding. High level radioactive wastes have different radiation spectra, depending upon composition and age. If desired, an inner liner may be selected for thermalizing the high energy radiation stream (not shown). By lowering the radiation level at the container surface, radiation accelerated corrosion is depressed. Copper-beryllium alloy has a high thermal conductivity and diffusivity as compared to other material options. The added thermal loading of the container inner surface is dissipated without significantly raising the temperature of the secured waste within body 4. Alternatively, for a given wall thickness, the preferred copper-beryllium container 2 or 12 and contents 102 will reach a lower equilibrium temperature than containers fabricated from most other materials. Also, for a given container wall strength or corrosion integrity, the copper-beryllium provides a wall thickness that can be made thinner than possible with other materials, thereby lowering the operating temperature of the contents.

The containers 2 or 12 are provided with the closure weld 10 for insuring a high integrity seal, and a unified structural integrity for the associated container 2 or 12. After heat treating, the weld properties are significantly enhanced, approaching the properties of the bulk container 2 or 12 material.

The illustrated preferred weld technique produces a heat affected zone which is narrow and exhibits characteristics of both cast material and material in the solution annealed condition. By selecting materials as indicated above, a weld filler material is provided having a low heat treatment temperature. Accordingly, the mechanical strength of the precipitation hardened weld filler 10 can be heat treated to approach the Yield and Ultimate levels of the surrounding material of the dome lid 6 or cup lid 8 and body 4. Also, heat treating is conducted, as indicated below, for recovering the heat affected zone properties and enhancing, to approach physical levels of the container 2 or 12 material prior to welding. Also, elongation, fatigue integrity and thermal-electrical conductivity are favorably altered through a preferred heat treatment sequence to be described. In addition, this heat treating process relieves the residual stresses produced during the welding operation, thereby enhancing the corrosion resistance of the weld filler 10, heat affected zone and adjacent parent material of body 4 and the associated lid 6 or 8.

Figure 34:
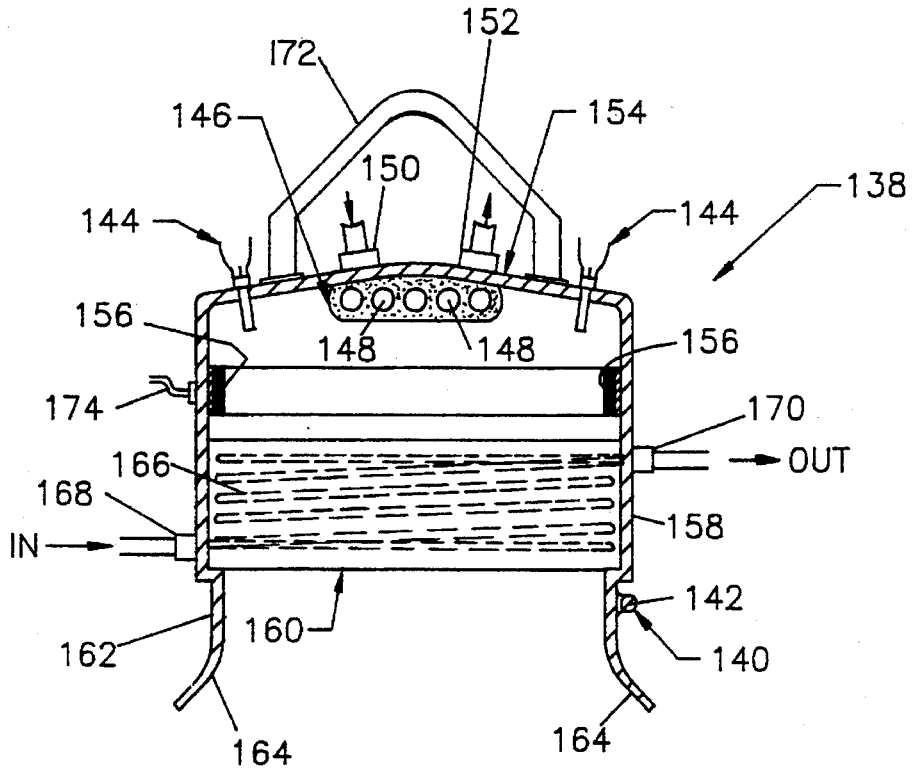
FIG. 34 shows a heat treating apparatus for heat treating welds joining the lids to the cylindrical containers for various embodiments of the invention, the heat treating apparatus itself being shown in a partial sectional view representative of another embodiment of the invention.

The heat treatment of the weld zone is accomplished in the preferred embodiment through use of the heat treating apparatus 138 shown in FIG. 34. As will be described, this apparatus 138 permits the weld heat treatment to be carried out at a temperature-time combination that does not affect the properties of the container material. The apparatus 138 provides a method of heating and heat sinking that limits the thermal effects to a narrow zone surrounding the weld. In this manner, residual stresses, resulting from the prior welding operation, are attenuated through the heat treatment operation.

Figure 35:
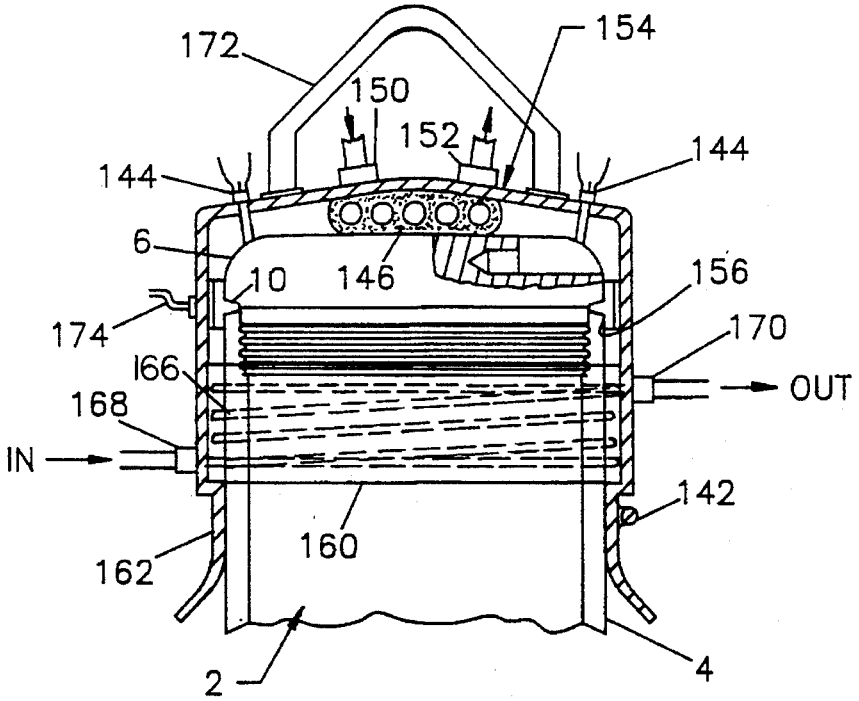
FIG. 35 is a partial sectional view of the heat treating apparatus of FIG. 34 shown installed in place over a cap or lid and an upper portion of the cylindrical body of an embodiment of the invention.
Figure 36:
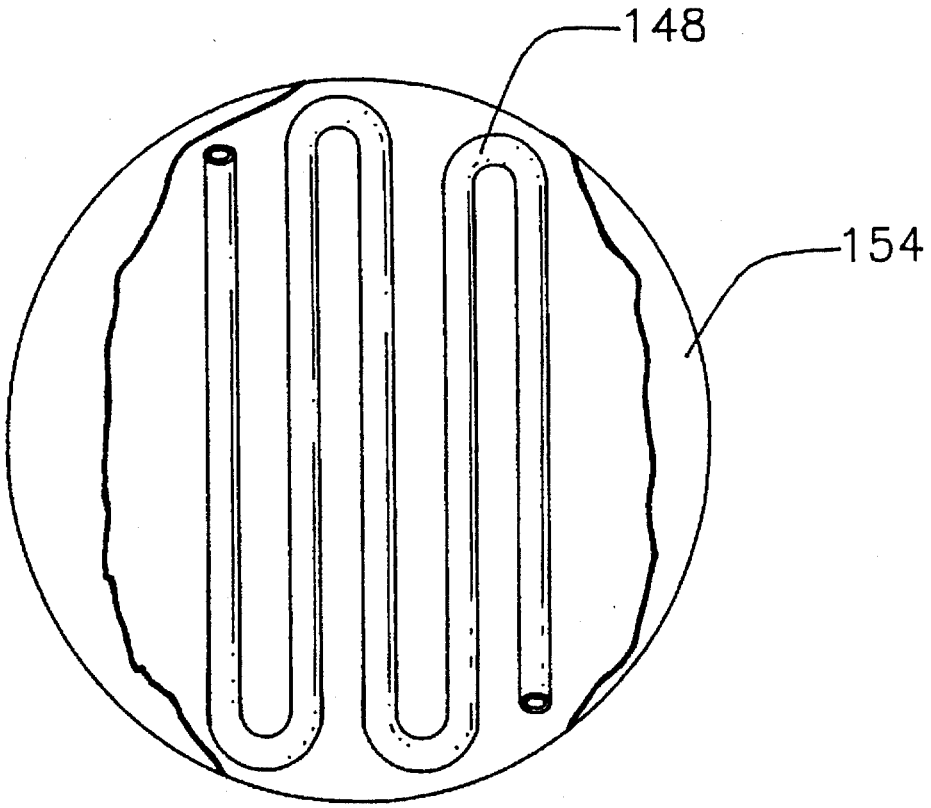
FIG. 36 is a partial cutaway view of the top of a heat treating device of one embodiment of the invention for showing the configuration of a cooling coil thereunder.

With further reference to FIG. 34, the heat treating apparatus 138 is shown in cross section, and is formed in a shape of a substantially cylindrical cap or jacket for fitting over the top portion of either of the container embodiments 2 or 12, respectively, as will be described in greater detail below. The assembly may be installed, operated and monitored remotely. The heat treating device or apparatus 138 includes a securing band 140 attached to the outside surface of secondary wall 162, for securing the apparatus 138 onto the containers 2 or 12, after appropriate positioning. The securing band 140 is of a conventional type, and includes a rotating element 142 for either tightening the band to secure heat treating apparatus 138 to a container 2 or 12, or turning in the opposite direction for loosening the securing band 140 to permit removal of the heat treating apparatus 138 from its associated container 2 or 12. Spring loaded thermocouples 144 are mounted on and through holes in top portion 154, and are provided for monitoring the temperature of the dome lid 6, in this example, having its weld 10 heat treated via apparatus 138. An inflatable cooling pad 146 including a plurality of interconnected cooling tubes 148 have coolant circulated continually therethrough. Cooling tubes 148 can be arranged in any practical configuration, such as that shown in FIG. 36, for example. The coolant is received from a fluid input port 150, circulated through tubes 148, and discharged from a fluid output port 152. The top portion 154 of the heat treating apparatus 138 is closed, and in this example has an upwardly projecting curvature relative to the container 2 or 12. A heater array 156 is positioned in an area about the circumference of the inside sidewalls 158 for permitting the band heater 156 to be centered upon and surrounding the weld 10 of a lid 6 or 8 being heat treated (see FIG. 35). The top 154 and sidewalls 158 form a cap-like housing for heat treating apparatus or device 138. An inflatable cooling jacket 160 is attached to approximately the lower half circumferential portion of the inside surface of sidewall 158, as shown. These sidewalls 158 form a secondary sidewall portion 162 slightly less in diameter than the main sidewall portion 158. The inside diameter of the collar-like secondary sidewall portion 162 is dimensioned to have a close fit with the sidewalls of an associated body 4, as shown in FIG. 35. Sidewall portion 162 is tightened on assembly with the securing band 140 and mechanism 142. Note that the bottom-most portion 164 extending from the secondary sidewall 162 is flared outward and away from the sidewall 162, as shown. The flared portion 164 serves to provide an easy guide for initially centering the heat treating device or apparatus 138 on the top portion of a container 2 or 12, allowing remote installation.

The cooling jacket 160 consists of a cooling tube coil 166 that includes at one end a fluid input port 168 for receiving coolant, and at the other end a fluid output port 170 for discharging coolant circulated through the cooling coil 166. Lastly, a lifting bracket 172 is fixed to the top 154 of heat treating apparatus 138, for permitting handling apparatus to hook onto the heat treating device 138 for remotely positioning it onto the top portion of a container 2 or 12 to initiate heat treating of an associated weld 10.

In FIG. 35, the heat treating apparatus 138 is properly positioned and secured over the top portion of a container 2, in this example, for heat treating the weld 10 between a dome lid 6 and body 4. Electrical power is provided to heater 156 via an electrical cable 174, as shown. In this example, the weld 10 in the associated weld zone is heat treated for a predetermined time at a predetermined temperature. The required heat treatment is determined for providing that the properties of the material of the associated lid 6, in this example, and body 4 remain substantially unaffected, while triggering age hardening of the heat affected zone about the weld 10, and more importantly of the weld filler 10. It is important to note that the heat treatment for the weld filler is predetermined for precipitation hardening the weld filler 10 from the cast state. The weld filler material is beryllium-copper C17200 in the preferred embodiment, as previously mentioned. In the preferred embodiment, heat treating is carried out for the weld 10 and surrounding heat affected zone from 0.5 to 5 hours at a temperature ranging from 775° F. to 950° F. The preferred values for these ranges are up to 5 hours at a nominal 850° F. However, in other applications, and for different materials, different temperatures and time periods may be utilized. As the heat treating is carried out through use of the heat treating apparatus 138, coolant is circulated through the cooling pad 146, and cooling jacket 160, while monitoring the temperature at points along the dome lid 6 through use of thermal couples 144, as shown.

Note that the present inventor anticipates that the heater or heat coil 156 will have localized Eddy current measuring transducers equally spaced from one another and included in segments of the heater 156, for permitting resistance measurements of the weld zone given areas. In this manner, the heat treating or aging process can be monitored for completeness non-destructively. For example, it is anticipated that the Eddy current transducers (not shown) will consist of single turn coils used to pick up Eddy currents induced into the weld. It should further be noted that all of the processing illustrated herein is to be carried out remotely in view of the radioactivity hazard presented by the spent fuel assembly 102, in this example.

As previously mentioned, the design of the cup lid 8 facilitates the attainment of strict quality requirements for the long term storage of nuclear waste material within associated container 12. As shown in FIG. 10, an index track 44 is provided on cup lid 8 for facilitating the identification of weld positions during either x-ray inspection or reflected wave ultrasonic transmission inspection. Reflection ultrasonic transmission inspection can be provided through an immersion technique whereby the interior of cup lid 8 is filled with a coupling liquid, and by keying to the indexed track 44 on the interior sidewall of the cup 8, such inspection can be carried out. Alternatively, for wave transmission examination through the weld 10, a ring container can be attached to the outer wall of body 4 or rim of cup lid 8, and filled with a coupling fluid. In conjunction therewith, a bracket holding the transmitter/receiver transducers can then be driven around the weld perimeter for scanning the weld 10 to provide an inspection thereof. Such commercially available inspection equipment must be customized for this specific application.

The sidewalls of slots 18 of dome lid 6, and interior walls of the holes 40 of cup lid 8 provide torquing surfaces for screwing the associated lids into the top of a body 4. Also, the tapered holes 22 of dome lid 6, and through holes 40 of cup lid 8, provide lifting surfaces. Accordingly, the dome lid 6 and cup lid 8 each provide as described above symmetric lifting/torquing surfaces, integrated into the associated lid design in a manner avoiding any protrusions from the lids, for simplifying remote handling. With either of the dome lid 6 or cup lid 8 configurations, the associated container 2 or 12, respectively, provides for use of a remote manipulator having a 3 point finger assembly for centering itself on an associated dome lid 6 or cup lid 8. The remote manipulator must be designed to first center itself on the top of a dome lid 6 or cup lid 8, whereafter downward translation of the remote manipulator relative to the associated lid 6 or 8 causes triggering of a centering cam of the manipulator upon contact with the top of the associated lid 6 or 8, causing appropriate lifting studs to engage either the tapered holes 22 of dome lid 6, or through holes 40 of cup lid 8 via the driving of three lifting studs radially into these holes, respectively. The manipulator mechanism can then be used for lifting the associated lid 6 or 8 into position upon a body 4 for thereafter screwing the associated lid into the body 4, and for thereafter lifting the mechanically sealed container 2 or 12, respectively, to a desired location. It is believed that presently available manipulators can be easily modified to provide the required manipulator mechanism in association with the dome lid 6, or cup lid 8. Different manipulator mechanisms are required for use with each one of the dome lid 6 or cup lid 8, respectively.

Figure 37:
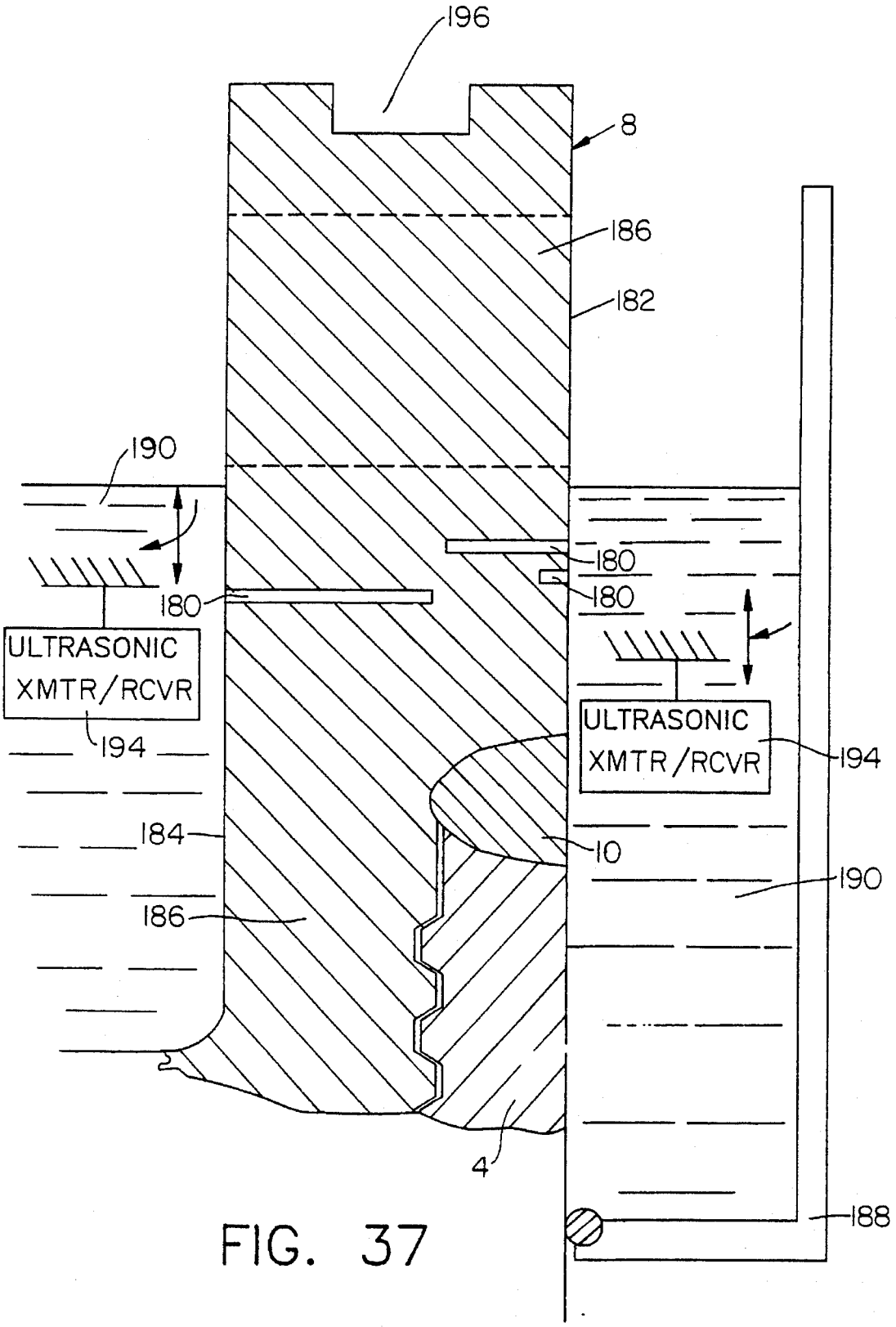
FIG. 37 shows the weld region of the cup lid inspected by using ultrasonic techniques.

FIG. 37 details the weld region of the cup lid 8 which has been welded to the container. Since the cup lid 8 is particularly suited to long term storage of high level nuclear waste, the weld 10 integrity is an important feature to document. The cup lid 8 design allows the inspection of the weld region 10 using ultrasonic (UT) through transmission, ultrasonic reflection inspection techniques, and/or through transmission of X-rays. FIG. 37 illustrates the UT techniques. Integral with the cup lid are a series of drilled holes 180, usually flat bottom. These holes 180 are of various sizes and drilled to various depths. The design analysis of the structure identified a critical flaw size for the weld 10. The drilled holes 180 represent built-in calibration defects of a range of sizes and at various relevant depths. Typically the calibration sizes include a size one half and one quarter the critical size which are the reportable defect size thresholds. The calibration holes 180 must be drilled into the outer wall surface 182 and inner wall surface 184 since the UT reflection inspection signal may be sourced from either side 182 or 184 of side wall 186.

Procedurally, a container 188 is attached to the outside of the cup type lid 8, as shown, and both the container 188 and the lid 8 are filled with UT coupling fluid 190. A fixture 192 which is indexed circumferentially and contains two transmitter/receiver assemblies or transducers 194 is referenced with a channel or groove 196 on the top of lid 8. The defect calibration standards are scanned with the transducers 194 at an elevation above the weld 10 zone. The circumferential position is established with reference to the location of specific calibration defects. The weld 10 zone is then inspected using both ultrasonic through transmission and ultrasonic reflection inspection techniques from both directions, that is from either side of wall 186.

Figure 12:
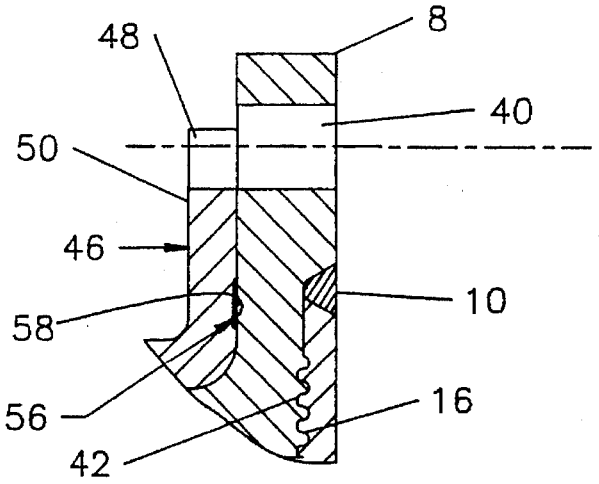
FIG. 12 shows a detailed view of a portion of the retainer of FIG. 11.
Figure 14:
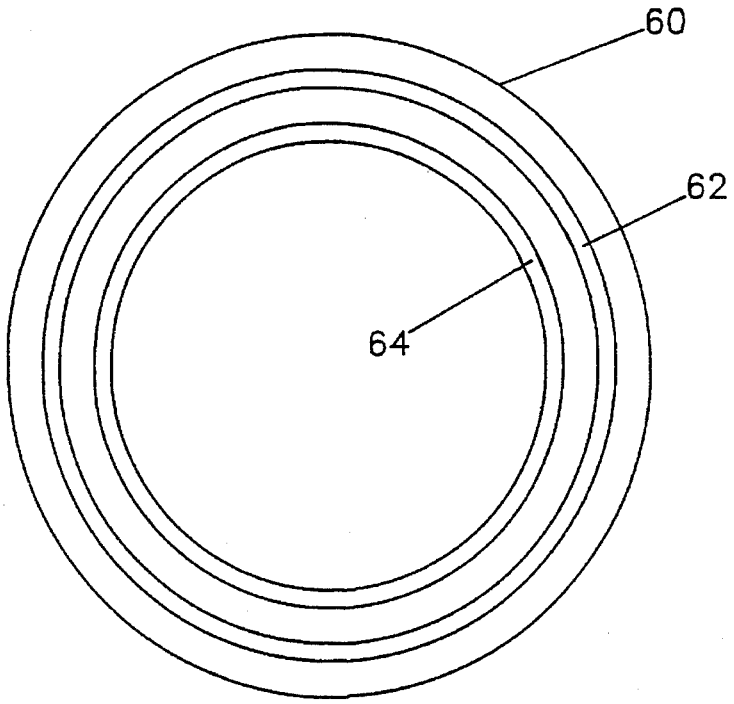
FIG. 14 is a bottom view of the metal "O"-ring and disk assembly of FIG. 13.
Figure 38:
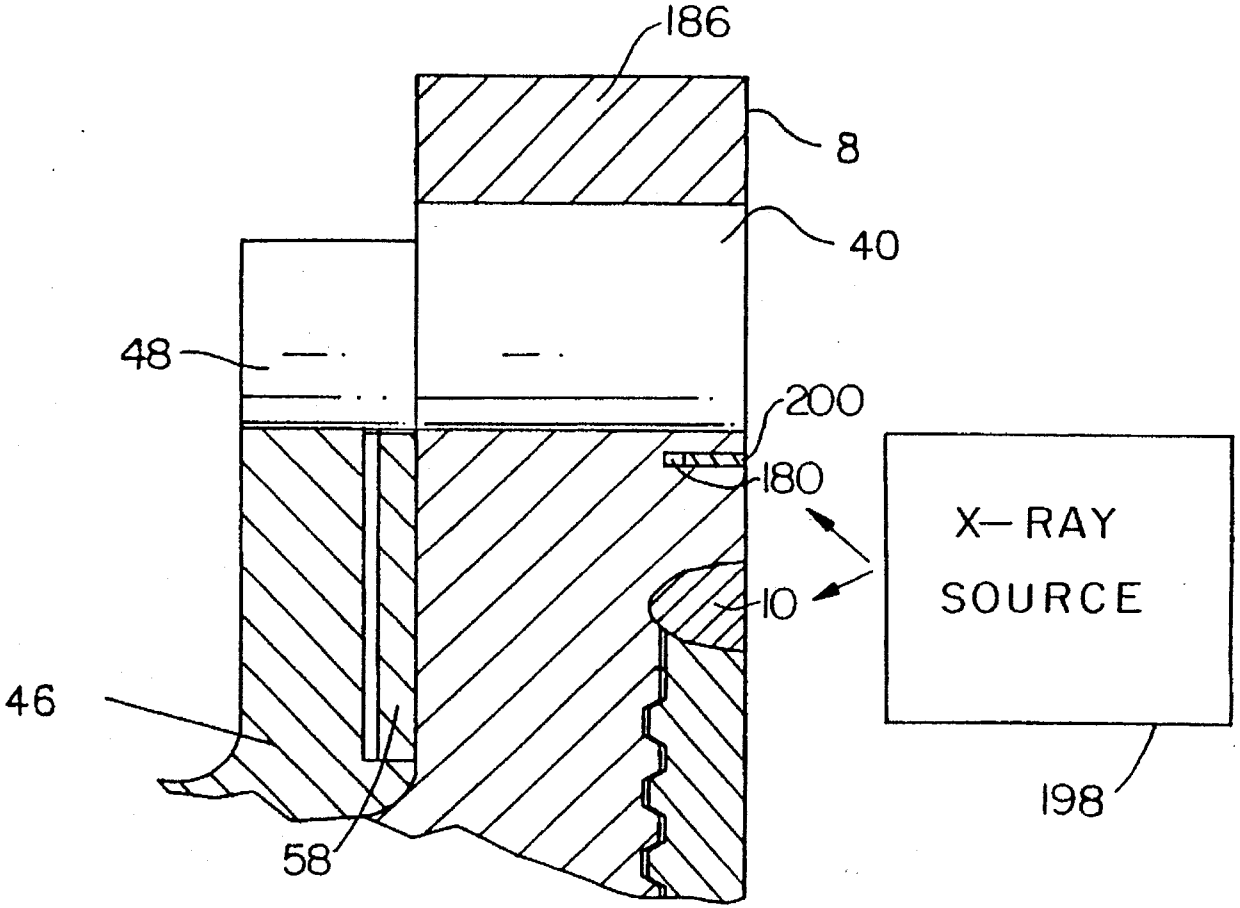
FIG. 38 shows an X-ray apparatus for inspecting the weld region of the cup lid.

An apparatus in support of the X-ray inspection of the weld region is illustrated in FIG. 38 (also see FIG. 12). The film holder/film shield 46 is an assembly which supports the X-ray film 58 at a precise location, aligns it with respect to the weld 10 and calibration holes 180 and locks into a circumferential position. The calibration holes 180 are flat bottom, drilled holes of various sizes relative to the critical defect size of the weld filter and side wall, as previously described for FIG. 37. These holes 180 are plugged with a rod 200 such that the entrapped volume is relevant in size to a critical defect. The exposed X-ray film 58 contains a record of the weld 10, the side wall 186 and the calibration defects which also record absolute position. An X-ray source 198 radiates the weld 10 zone, and calibration hole 180 regions in a manner exposing film 58 with X-rays passed through these regions.

Although various embodiments of the invention are described herein for purposes of illustration, they are not meant to be limiting. Those of skill in the art may recognize modifications to these embodiments, which modifications are meant to be covered by the spirit and scope of the appended claims.

What is claimed is:

1. In a container comprising a lid and a cylindrical body, the improvement comprising a seal assembly included therewith for providing a seal between an internal shoulder of said cylindrical body and bottom of said lid screwed into an open top portion of the clindrical body, with the bottom of said lid being in relatively close proximity to a surface of said shoulder when said lid is screwed fully into the top of said cylindrical body, said seal assembly comprising:

a soft non-corrosive metal coating on said shoulder;

a metal disk having a substantially flat top side and a substantially flat bottom side;

two concentric metal "O"-rings, each coated with a soft non-corrosive metal, rigidly affixed to the bottom side of said disk, whereby when said lid is screwed into said body, the bottom of said lid is rotated against the top side of said disk for compressing said metal "O"-rings into the plastic regime to flatten them against said shoulder of said body for providing a double "O"-ring seal therebetween.

2. The seal assembly of claim 1, wherein said "O"-rings are welded to the bottom side of said disk.

* * * * *